US008711136B2

(12) United States Patent
Park

(10) Patent No.: US 8,711,136 B2
(45) Date of Patent: Apr. 29, 2014

(54) SYSTEM AND METHOD FOR CALIBRATING DISPLAY DEVICE USING TRANSFER FUNCTIONS

(75) Inventor: Jaeyeol Park, Seoul (KR)

(73) Assignee: Taebo Jung, Gwangju (KR)

( * ) Notice: Subject to any disclaimer, the term of this patent is extended or adjusted under 35 U.S.C. 154(b) by 180 days.

(21) Appl. No.: 13/366,524

(22) Filed: Feb. 6, 2012

(65) Prior Publication Data

US 2013/0135272 A1 May 30, 2013

(30) Foreign Application Priority Data

Nov. 25, 2011 (KR) ..... 10-2011-0124526

(51) Int. Cl.
*G09G 5/00* (2006.01)

(52) U.S. Cl.
USPC ..... 345/211; 345/89; 345/204; 345/69; 345/691

(58) Field of Classification Search
None
See application file for complete search history.

(56) References Cited

U.S. PATENT DOCUMENTS

| | | | |
|---|---|---|---|
| 7,486,303 | B2 | 2/2009 | Akai et al. |
| 2002/0186230 | A1 | 12/2002 | Kudo |
| 2009/0079727 | A1 | 3/2009 | Ozawa |
| 2010/0123731 | A1 | 5/2010 | Morimoto |
| 2011/0050749 | A1 | 3/2011 | Park |
| 2011/0199395 | A1 * | 8/2011 | Nathan et al. ..... 345/690 |

FOREIGN PATENT DOCUMENTS

| | | | |
|---|---|---|---|
| JP | 2002/366112 | A1 | 12/2002 |
| JP | 2004/146936 | | 5/2004 |
| JP | 2007/028333 | | 2/2007 |
| JP | 2008-503185 | | 1/2008 |
| JP | 2008-129334 | | 6/2008 |
| JP | 22009/80252 | | 4/2009 |
| JP | 2010-122506 | | 6/2010 |
| JP | 2011/48318 | | 3/2011 |
| WO | WO2005124663 | A2 | 12/2005 |
| WO | WO2009-028675 | A1 | 8/2008 |

* cited by examiner

*Primary Examiner* — Bipin Shalwala
*Assistant Examiner* — Lisa Landis
(74) *Attorney, Agent, or Firm* — Patent Office of Dr. Chung S. Park

(57) ABSTRACT

The present invention provides a voltage transfer function, a luminance transfer function, and a transfer factors (for example, efficiency, critical point, and slope) between these two functions, derives the correlation (based on the condition change in all cases) between an input grayscale voltage and output luminance, and calibrates the input grayscale voltage by a difference between measurement luminance and target luminance using the transfer functions. Therefore, the present invention can respond to change in conditions for all cases, and increase the accuracy, easiness, and generalization of calibration compared to the existing calibration scheme that relies on the lookup table by checking the actual measurement data and readjusting the transfer factors in each calibration stage. Moreover, the present invention can further increase the manufacturing yield by an average of 35% than the existing yield, significantly saving the manufacturing cost.

20 Claims, 30 Drawing Sheets

SYSTEM AND METHOD FOR CALIBRATING DISPLAY DEVICE USING TRANSFER FUNCTIONS

This application claims the benefit of Korea Patent Application No. 10-2011-0124526 filed on Nov. 25, 2011, the entire contents of which is incorporated herein by reference for all purposes as if fully set forth herein.

BACKGROUND

Field

The present invention relates to calibration of a display device.

Conventional display devices include Liquid Crystal Display (LCD) devices, Field Emission Display (FED) devices, Plasma Display Panels (PDPs), and Organic Light Emitting Diode (OLED) display devices, for example.

Among such display devices, OLED display devices are self-emitting devices and include a plurality of OLEDs. The OLED includes an anode electrode, a cathode electrode, and an organic layer formed therebetween. The organic layer includes a Hole Injection layer (HIL), an Emission layer (EML), a Hole transport layer (HTL), an Electron transport layer (ETL), and an Electron Injection layer (EIL). When a cell driving voltage is applied to the anode electrode and the cathode electrode, holes passing through the HTL and electrons passing through the ETL move into the EML to form excitons, causing the EML to emit visible light.

In general, an OLED display device includes a plurality of red (R) sub-pixels, green (G) sub-pixels, and blue (B) sub-pixels that respectively include the OLEDs and are arranged in a matrix form. The OLED display device selectively turns on Thin Film Transistors (TFTs), which are active elements, to select specific sub-pixels with a scan pulse, and then supplies digital image data to the selected sub-pixels, thereby controlling the luminance of the sub-pixels according to the grayscale levels of the digital image data.

In OLED display devices, a plurality of pixels enabling the representation of various colors are implemented by the combination of the sub-pixels, and the white balance of the pixels is adjusted by controlling the adjustment rate of RGB sub-pixels. Each of the sub-pixels includes a driving TFT, at least one or more switching TFTs, and a storage capacitor. The luminance of each sub-pixel is proportional to a driving current that flows in an OLED thereof.

Such OLED display devices, as self-emitting devices that self-emit light, are thin and light in weight and can provide high-definition images with wide view angles and fast response time. Also, unlike LCD devices, OLED display devices are capable of presenting full colors without using additional color filters, which attracts attention of display designers. However, OLED display devices still have technical difficulties to be overcome.

First, OLED display devices are lower than LCD devices in manufacturing yield. To increase the manufacturing yield, a characteristic deviation due to the manufacturing process deviation of a driving TFT and OLED, the critical point (threshold voltage) deviation of TFTs used for a back plane, and the critical point deviation of an organic layer material needs to be reduced.

Second, in OLED display devices, the difference in efficiencies of RGB sub-pixels gradually increases as the remaining service life of the device decreases, and consequently, white balance changes from the intended level. The service life and efficiency of OLED display devices have been improved during the past several years, but still need to be further improved so as to provide enhanced stable uniformity especially for large-area OLED display devices. Also, in OLED display devices, it is required to reduce the difference in luminance change due to the change of ambient temperature and the change of light leakage current, and the difference in service-life decrease due to the difference in luminance change.

Third, an OLED display device is affected by static IR drop due to the resistance difference caused by positions of a power supply line for supplying a cell driving voltage to the OLED, and dynamic IR drop due to the resistance difference (which is caused by the change in the amount of data) between neighboring sub-pixels. Display luminance is proportional to the level of driving current that flows in an OLED, and a resistance difference is expressed as a difference in cell driving voltages. When a cell driving voltage is supplied to each sub-pixel, a voltage drop by the static IR drop and the dynamic IR drop, occurs, and as a consequence, a crosstalk occurs, where display luminance is partially changed according to the screen state based on the change in a display position and an amount of data. If these technical problems of OLEDs of the self-emission current driving type are not solved, a large-area and high-definition OLED display device cannot be implemented.

To solve the technical problems of OLED display devices, various calibration schemes have been applied thereto during the manufacturing process or after the completion of the manufacturing process. However, the conventional calibration schemes use only a lookup table having experimental data that are obtained under a predetermined limited condition.

To generate a lookup table, a plurality of predictable conditions between voltage characteristic and luminance characteristic are set up, and, then, actual experimental data are obtained under the conditions to establish the relationship between the voltage characteristic and luminance characteristic. The lookup table scheme is used when a transfer function between the voltage characteristic and luminance characteristic is complicated or cannot be derived. Since it is impossible to secure actual measurement data under all of the possible conditions, the conventional lookup table scheme secures actual measurement data under limited range of conditions, and uses the secured data for the connection.

However, such a conventional lookup table scheme has many limitations in terms of the easiness and accuracy of calibration.

In the conventional lookup table scheme, it takes considerable amount of time to generate lookup table data, and actual measurement data should be acquired and applied each time an external environment that matches an external condition is changed, causing the difficulty in calibration. Also, the lookup table scheme performs an operation, which compares, checks, and readjusts actual measurement data by stage for each calibration work in a manufacturing process, and thus, a calibration time and a manufacturing tack time become considerably long.

Since the conventional lookup table scheme mainly uses an approximate value when a condition range is narrowly set such that there are no data suitable for a desired condition, it is difficult to perform accurate calibration. According to the conventional lookup table scheme, it is impossible to actually measure data for a large number of combinations in all cases, it is difficult to accurately match a white balance value based on the combination of red, green, and blue, and it is difficult to accurately calibrate luminance non-uniformity due to IR drop. Furthermore, according to the conventional lookup table scheme, it is difficult to respond image quality that is degraded upon lapse of operation time after a complete product is produced, there is no method that adjusts white balance which is changed by the difference in service-life of red, green, and blue materials, and it is impossible to re-calibrate image quality in repairing the OLED device.

Despite such difficulties, the reason that most of current calibration schemes use the lookup table is because a relationship between an input grayscale voltage and output luminance cannot be derived as an accurate transfer function.

SUMMARY

An aspect of the present invention provides a calibration system of a display device and a calibration method thereof, which derive a relationship between an input grayscale voltage and output luminance as a transfer function and a transfer factor, and performs calibration using the transfer function and the transfer factor, thus enabling the accuracy, easiness, and generalization of calibration.

In an aspect, a calibration system of a display device includes: a display panel; a data driving IC configured to generate a grayscale voltage which is applied to the display panel, according to a predetermined gamma register value; a transfer function processing unit configured to apply a measurement luminance value, a voltage condition, and the predetermined gamma register value to a transfer function algorithm to calculate a plurality of changed second transfer factors, and calculate an auto register for changing the gamma register value by a difference between the first and second transfer factors, wherein the transfer function processing unit includes: a voltage transfer function for calculating a voltage condition for change of luminance; a luminance transfer function for calculating a luminance value based on change of a voltage; and the transfer function algorithm including a plurality of first transfer factors corresponding to a correlation between the voltage transfer function and the luminance transfer function, as a logic circuit, and the measurement luminance value is obtained by applying a test pattern having a specific grayscale voltage value to the display panel; a driving board configured to include a default code memory storing a default code including a default register which is used to calculate the auto register, a target code memory storing a target code including a target register which is used to calculate the default register, and a voltage generator generating a driving voltage necessary for driving the display panel and the data driving IC; a luminance measurer configured to measure luminance of the display panel according to application of the test pattern; and a control center configured to receive an initial driving condition of the data driving IC, and apply a work command signal for sequentially performing calibrations and luminance measurement data to the transfer function processing unit, the luminance measurement data being supplied from the luminance measurer.

In another aspect, a calibration method of a display device includes: executing an algorithm which is a transfer function including a voltage transfer function and a luminance transfer function, for calibrating change of output luminance to a desired value through calibration of an input voltage; performing a target calibration stage of applying a target luminance value and an arbitrary grayscale voltage value to the transfer function to calculate a plurality of target calibration transfer factors, and matching a slope factor of the voltage transfer function with a slope factor of the luminance transfer function to calculate a target register through a transfer function operation using the target calibration transfer factors; performing a zero calibration stage of applying a measurement luminance value, which is obtained by applying a grayscale voltage value based on the target register to the display panel, to the transfer function to calculate a plurality of zero calibration transfer factors, and applying the zero calibration transfer factors and the target luminance value to the transfer function to calculate a default register for compensating for a difference between the target calibration transfer factors and the zero calibration transfer factors with a gamma voltage; and performing an auto calibration stage of applying a measurement luminance value, which is obtained by applying a grayscale voltage value based on the default register to the display panel, to the transfer function to calculate a plurality of auto calibration transfer factors, and applying the auto calibration transfer factors and the target luminance value to the transfer function to calculate a default register for compensating for a difference between the zero calibration transfer factors and the auto calibration transfer factors with a gamma voltage.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Embodiments of the present invention will be described with reference to the accompanying drawings, in which like numbers refer to like elements throughout. In describing the present invention, if a detailed explanation for a related known function or construction is considered to unnecessarily divert the gist of the present invention, such explanation has been omitted but would be understood by those skilled in the art.

Hereinafter, preferable embodiments of the present invention will be described in detail with reference to FIGS. 1 to 32.

In the specification, a display device including RGB OLEDs will be described as an example, but the spirit and scope of the present invention are not limited thereto. The present invention may be applied to other self-emitting display devices such as a display device including white OLEDs and color filters and a plasma display panel. Also, the present invention may be applied even to a display device that adjusts luminance with a voltage and a current.

In the specification, (1) a voltage transfer function and a luminance transfer function are derived and defined, (2) a calibration system required for calibration processing based on a transfer function is described, and (3) a specific calibration method and application based on the transfer function are described.

Terms to be used for the detailed description of the present invention are defined as follows.

An initial code indicates a group of various registers for setting an initial driving condition of a data driving IC. The initial code includes a register for setting a driving voltage, a register for setting resolution, a register for setting a driving timing, a register for setting a driving signal, and a gamma register for setting a gamma resistor. The registers included in the initial code are defined as initial registers.

The target code is a code that is generated by performing target calibration with a transfer function. The target code includes a target register for updating an initial setting value of the gamma register among the initial registers.

The default code is a code that is generated by performing zero calibration with a transfer function. The default code includes a default register that is updated on the basis of the target register. The default code is used as a reference code that is used for each production sample in performing auto calibration for production.

The auto register is generated by updating the default register to a register that is generated by performing auto calibration with a transfer function.

An aging register is generated by updating an auto register to a register that is generated by performing aging calibration with a transfer function.

1. Voltage-Luminance Transfer Function

Figure 1:
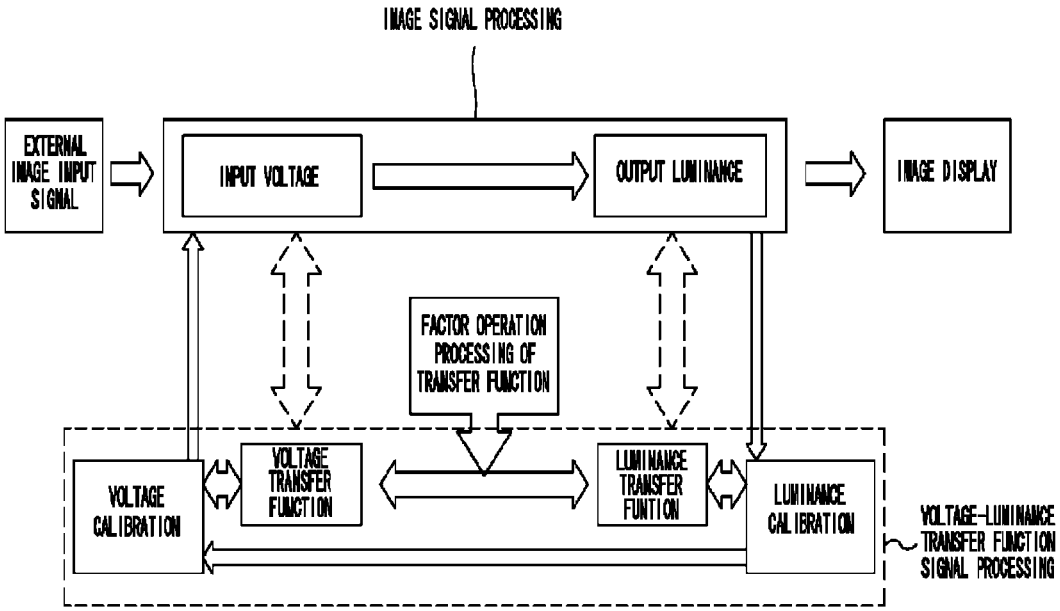
FIG. 1 is a diagram illustrating a correlation between a grayscale voltage inputted through a data driving Integrated Circuit (IC) and output luminance realized by an OLED, and a voltage transfer function and a luminance transfer function which express the equivalent of the correlation.

FIG. 1 illustrates a correlation between a grayscale voltage inputted through a data driving IC and output luminance realized by an OLED, and a voltage transfer function and a luminance transfer function which expresses the equivalent of the correlation.

As illustrated in FIG. 1, a transfer function is a correlation equation between a grayscale voltage being an input condition and luminance (luminance of an OLED) being an output condition in driving the OLED, and includes a voltage transfer function for calculating a voltage condition for the change of luminance, a luminance transfer function for deriving a luminance value based on the change of a voltage, and a plurality of transfer factors that are correlation coefficients between the two transfer functions. Therefore, the transfer function is defined as a mathematical equation that enables a desired target value to be easily obtained.

Figure 2A:
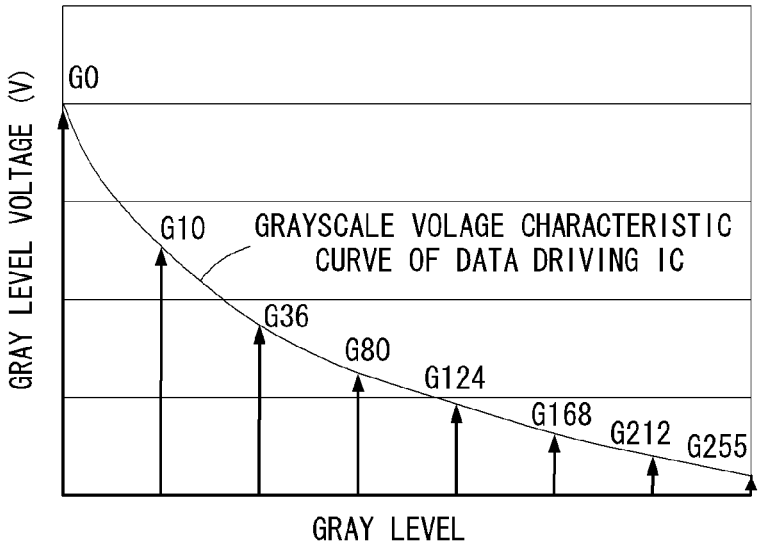
FIG. 2A is a diagram showing a grayscale voltage characteristic curve of the data driving IC for a panel which uses a P-type Low Temperature Poly Silicon (LTPS) backplane.

FIG. 2A shows a grayscale voltage characteristic curve of the data driving IC for a panel which uses a P-type Low Temperature Poly Silicon (LTPS) backplane. In FIG. 2A, the abscissa axis indicates a grayscale level, and the ordinate axis indicates an input voltage. The voltage transfer function is obtained by expressing a plurality of grayscale voltages, which are generated through voltage division by a gamma resistor string included in the data driving IC, as an exponential function, and is as expressed in Equation (1) below.

$$y=V-(a*(x/dx)^r+b) \quad (1)$$

where y indicates a grayscale of the data driving IC, V is a bias voltage of the data driving IC and indicates a difference between a high-level gamma source voltage VDDH and a low-level gamma source voltage, a indicates a gain of the voltage transfer function, b indicates an offset of the voltage transfer function, r indicates a slope (i.e., a slope of a gamma voltage characteristic curve) of the voltage transfer function, x indicates a grayscale level, and dx indicates the total number of grayscale levels.

Accordingly, the slope "r" of the voltage transfer function is expressed as Equation (2) below.

$$r=\mathrm{LOG}_{x/dx}[(-y+V-b)/a] \quad (2)$$

As shown in FIG. 2A, voltage vs grayscale has a certain slope "r" and has an inversely proportional relationship therebetween. This is because the driving bias characteristic of a driving element (driving TFT) formed at the P-type LTPS backplane has the exponential function characteristic of a negative slope. In the characteristic curve of a panel using an N-type LTPS backplane, voltage vs grayscale may have a proportional relationship therebetween.

Figure 2B:
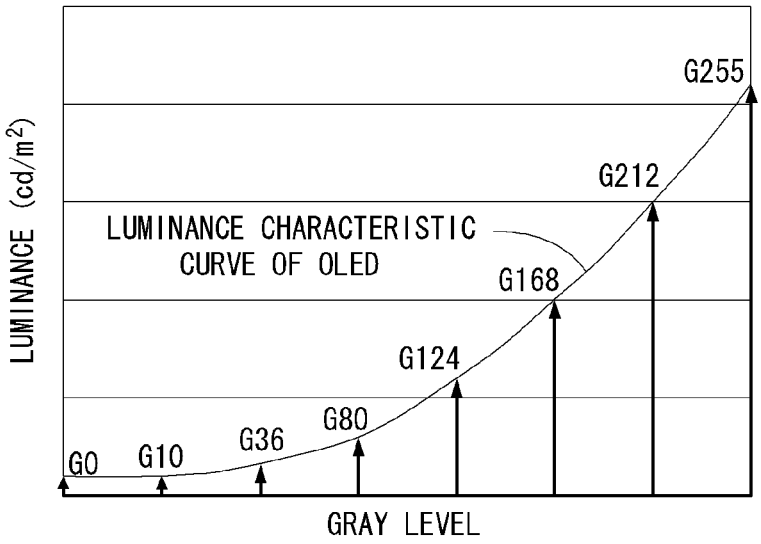
FIG. 2B is a diagram showing a luminance characteristic curve of an OLED.

FIG. 2B shows a luminance characteristic curve of an OLED. In FIG. 2B, the abscissa axis indicates a grayscale level, and the ordinate axis indicates an input voltage. The luminance transfer function is obtained by expressing output luminance based on grayscale voltages as an exponential function, and may be calculated as expressed in Equation (3) below.

$$Y=A*(x/dx)^{1/r}+B \quad (3)$$

where Y indicates luminance of an OLED, A indicates a gain of the luminance transfer function, B indicates an offset of the luminance transfer function, 1/r indicates a slope (slope of a luminance characteristic curve) of the luminance transfer function, x indicates a grayscale level, and dx indicates the total number of grayscale levels.

Accordingly, the slope "1/r" of the luminance transfer function is expressed as Equation (4) below.

$$1/r=\mathrm{LOG}_{x/dx}[(Y-B)/A] \quad (4)$$

As shown in FIG. 2B, gray scale vs output luminance has a certain slope "1/r" and has a proportional relationship therebetween. This is because the luminance of an OLED has the exponential function characteristic of a positive slope.

Figure 3:
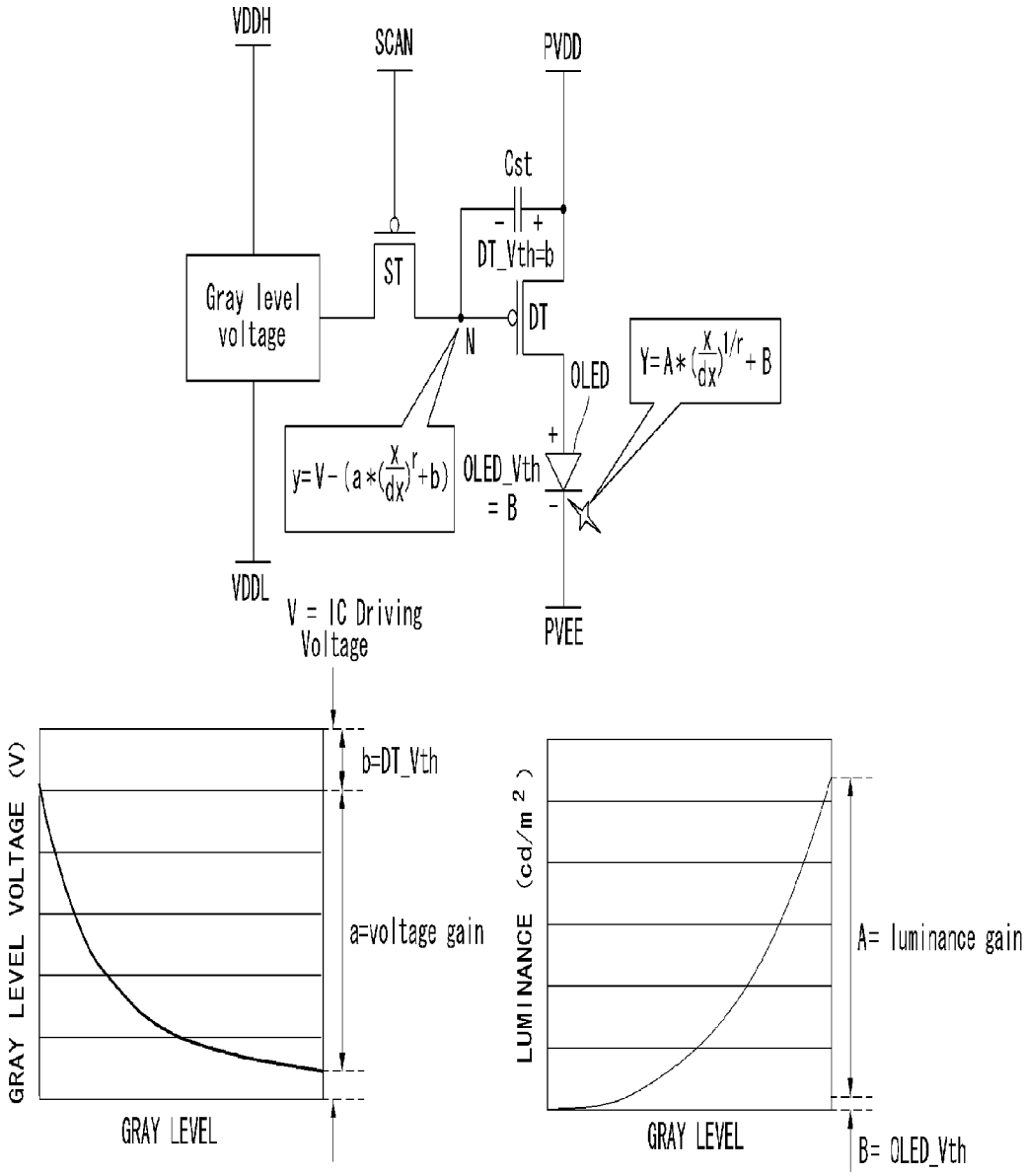
FIG. 3 is a diagram schematically illustrating a sub-pixel equivalent circuit of an OLED display device to which a voltage transfer function obtained from FIG. 2A and a luminance transfer function obtained from FIG. 2B are applied.

FIG. 3 schematically illustrates a sub-pixel circuit of an OLED display device to which the voltage transfer function defined as Equation (1) and the luminance transfer function defined as Equation (3) are applied.

Referring to FIG. 3, the sub-pixel circuit includes: an organic light emitting diode OLED that emits light when a driving current flows between a high-level cell driving voltage PVDD terminal and a low-level cell driving voltage PVEE terminal; a driving TFT DT that controls an amount of a driving current which is applied to the organic light emitting diode OLED according to a grayscale voltage applied to a gate node N thereof; a switching TFT ST that switches a current path between the gate node N of the driving TFT DT and a data line (not shown) with a grayscale voltage charged thereinto, in response to a scan pulse SCAN applied through a gate line (not shown); and a storage capacitor Cst that holds a grayscale voltage applied to the gate node N of the driving TFT DT, for a certain time.

The voltage transfer function is for a grayscale voltage that is applied to the gate node N of the driving TFT DT and corresponds to an image signal. b is an offset of the voltage transfer function and corresponds to a critical point (threshold voltage value) of the driving TFT DT. The luminance transfer function is for output luminance corresponding to an amount of light emitted from the organic light emitting diode OLED. B is an offset of the luminance transfer function and corresponds to a critical point (threshold voltage value) of the OLED.

Figure 4:
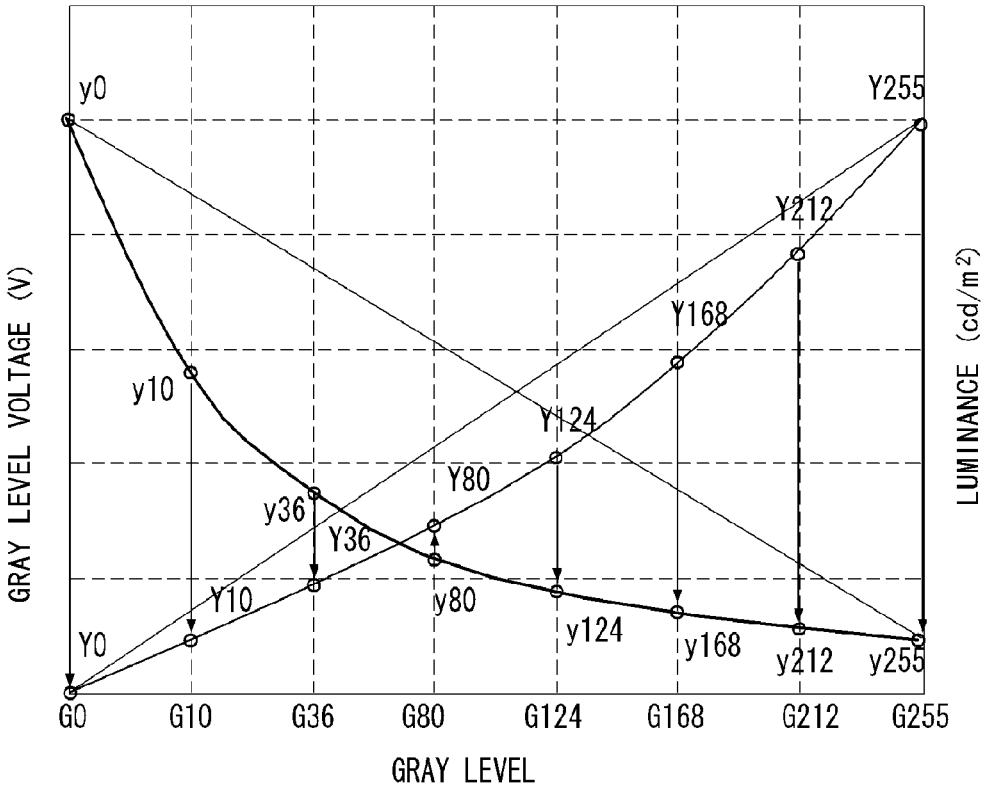
FIG. 4 is a diagram showing a correlation between a voltage transfer function and a luminance transfer function.

FIG. 4 shows a correlation between a voltage transfer function and a luminance transfer function. In FIG. 4, G0 to G255 indicate respective grayscale levels, y0 to y255 indicate respective gamma voltages corresponding to grayscale voltages, and Y0 to Y255 indicate respective output luminance corresponding to the grayscale levels.

In order to perform calibration, as shown in FIG. 4, a correlation between the voltage transfer function and the luminance transfer function is accurately mapped to a desired value. For example, output luminance of Y10 may be displayed in correspondence with a gamma voltage corresponding to y10, output luminance of Y124 may be displayed in correspondence with a gamma voltage corresponding to y124, and output luminance of Y212 may be displayed in correspondence with a gamma voltage corresponding to y212. In conventional approach, a look up table was used for the mapping. However, in the present invention, the voltage transfer function derived from Equation (1) and the luminance transfer function derived from Equation (3) are used for the mapping. For this end, the present invention derives transfer factors that are correlation coefficients between the voltage transfer function and the luminance transfer function.

Figure 5:
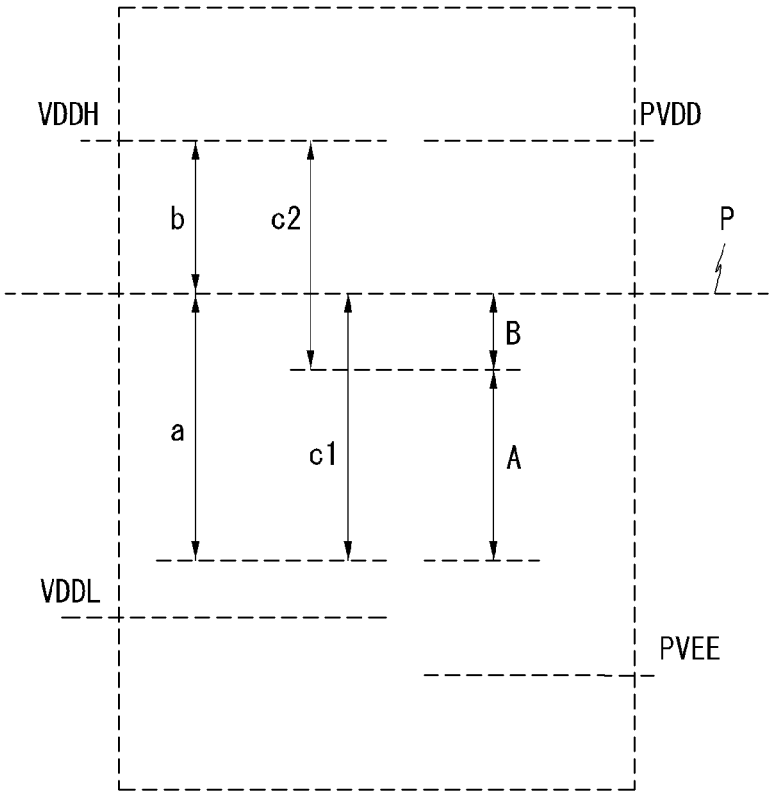
FIG. 5 is a diagram showing the principle which derives an efficiency proportional factor and a critical point proportional factor for defining a relationship between transfer functions.

The transfer factors of the transfer function include an efficiency proportional factor "c1" of FIG. 5, a critical point proportional factor "c2" of FIG. 5, the slope factor "r" of Equation (2), and the slope factor "1/r" of Equation (4).

The efficiency proportional factor "c1" is a value that transfers energy change between an input voltage and output luminance, and corresponds to actual emission efficiency. The efficiency proportional factor "c1" includes all variables between an input and an output that occur by a material characteristic difference, a pixel structure difference, a manufacturing process difference, an aging degree, the change of an ambient environment or the like, for instance. The efficiency proportional factor "c1" is for establishing a correlation between the voltage transfer function and the luminance transfer function, and may be mathematically calculated when an arbitrary voltage and luminance corresponding to the voltage are known. The efficiency proportional factor "c1" is used to calculate an input voltage value to be applied for obtaining target luminance under an actual condition. Using the efficiency proportional factor "c1", an input voltage for displaying of target luminance may be calculated as a simple function independently from various variables. Therefore, for an actual product, the engineer can easily calibrate luminance that is unnecessarily changed by the physical properties of a material, a structure, manufacturing, aging, and the change of an ambient environment, and thus uniformly maintain the emission characteristic of the product.

The critical point proportional factor "c2" is a threshold voltage condition where an OLED is actually driven when an input voltage is applied thereto. The critical point proportional factor "c2" is defined as a variable (on an arbitrary operation start time) that includes all variables between an input and an output that occur by a material characteristic difference, a pixel structure difference, a manufacturing process difference, an aging degree, the change of an ambient environment, mobility of a driving TFT, a parasitic capacitance difference or the like, for instance. The critical point proportional factor "c2" decides a start time of the voltage transfer function and a start time of the luminance transfer function. An amount of luminance is measured at an arbitrary light emission critical point by applying an arbitrary critical voltage, and the critical point proportional factor "c2" may be mathematically calculated based on a correlation between the arbitrary critical voltage and the measured amount of critical luminance. The critical point proportional factor "c2" is used to calculate, along with the efficiency proportional factor c1, an input voltage value to be applied for obtaining target luminance under an actual condition.

The slope factor "r" is a slope value included in the voltage transfer function and defined as an amount of changed voltage in each gray scale, and the slope factor "1/r" is a slope value included in the luminance transfer function and defined as an amount of changed luminance in each gray scale. The slope factor "r" of the voltage transfer function is a slope value that is obtained by calculating an amount of changed grayscale voltage (input voltage), based on the change of a setting value of a gamma register in the data driving IC, as an exponential function. The slope factor "1/r" of the luminance transfer function is a slope value that is obtained by calculating an amount of changed output luminance value for each grayscale voltage as an exponential function.

A value of the efficiency proportional factor "c1" is reflected in the slope factor "r" of the voltage transfer function, and a value of the critical point proportional factor "c2" is reflected in the slope factor "1/r" of the luminance transfer function. In other words, as expressed in Equations (1) and (2), an exponential value for the changed amount of each grayscale voltage value is the slope factor of the voltage transfer function, and, as expressed in Equations (3) and (4), an exponential value for the change of luminance obtained from each gray scale is the slope factor "1/r" of the luminance transfer function.

In the P-type LTPS backplane where the voltage transfer function and the luminance transfer function have an inversely proportional relationship therebetween, the slope factor "r" of the voltage transfer function and the slope factor "1/r" of the luminance transfer function have an inversely proportional relationship therebetween. The slope factors "r" and "1/r" enable the easy bidirectional arithmetic operation of the voltage transfer function and luminance transfer function. To calculate the slope factor "1/r" of the luminance transfer function, the slope factor "r" of the voltage transfer function is first calculated, and then, by calculating the reciprocal of the slope factor "r", the slope factor "1/r" of the luminance transfer function is obtained. Furthermore, a correlation equation based on a slope is established by applying the slope factor "1/r" to the luminance transfer function. On the contrary, to calculate the slope factor "r" of the voltage transfer function, the slope factor "1/r" of the luminance transfer function based on each grayscale voltage is first calculated, and then, by calculating the reciprocal of the slope factor "1/r", the slope factor "r" of the voltage transfer function is obtained. Subsequently, a correlation equation is established by applying the slope factor "r" to the voltage transfer function.

Unlike a theoretical equation, an operation that accurately matches a relationship between the slope factor "r" of the voltage transfer function and the slope factor "1/r" of the luminance transfer function in order for the slope factors and "1/r" to have an inversely proportional relationship therebetween, namely, an operation of forming a relationship of "r=1/r" is required in actual application. Such an adjustment operation is performed in an initial target calibration stage, and when the relationship between the slope factors "r" and "1/r" has been adjusted, the adjusted relationship is maintained as-is even in subsequent calibration stages (zero calibration, auto calibration, service-life calibration, etc.). Since the slope factor "r" of an initial voltage transfer function is determined by the data driving IC and an initial register, and target luminance is determined by a product spec, the relationship between the slope factors "r" and "1/r" that have been adjusted to match each other is reflected in a target register. A target register being a target calibration result becomes a driving condition of measurement luminance in performing zero calibration, and a default register being a zero calibration result becomes a driving condition of measurement luminance in performing auto calibration. Therefore, an inverse function proportional relationship between voltage and luminance is maintained as-is even after target calibration, and thus, in a subsequent calibration stage after target calibration, knowing the slope factor "1/r" of the luminance transfer function, the slope factor "r" of the voltage transfer function can be easily obtained by calculating the reciprocal of the slope factor "1/r". On the contrary, knowing the slope factor of the voltage transfer function, the slope factor "1/r" of the luminance transfer function can be easily obtained by calculating the reciprocal of the slope factor "r".

The transfer factors "c1", "c2", "r" and "1/r" of the transfer functions are separately calculated under a corresponding condition (for example, a voltage condition and a luminance condition) at each calibration stage (i.e., target calibration, zero calibration, auto calibration, and aging calibration are performed.) In the voltage transfer function and the luminance transfer function, a bidirectional arithmetic operation from a voltage to luminance or from luminance to a voltage may be performed based on the transfer factors "c1", "c2", "r" and "1/r". The changed amount of each of the transfer factors "c1", "c2", and "1/r" obtained in respective calibration stages is compensated for with a voltage difference for realizing of desired luminance.

Three reasons enabling a bidirectional arithmetic operation between the voltage transfer function and the luminance transfer function are as follows.

Firstly, the efficiency proportional factor "c1" and the critical point proportional factor "c2" include various change factors (environmental variables) that occur by a voltage-luminance relationship.

Secondarily, the slope factors "r" and "1/r" are for forming the relationship between the voltage transfer function and the luminance transfer function, and maintain a reciprocal relationship therebetween.

Thirdly, voltage representation based on the voltage transfer function and luminance representation based on the luminance transfer function are identically correlated to each other with the transfer factors "c1", "c2", "r" and "1/r".

These three reasons are fundamental principles of the present invention for formularizing a voltage-luminance relationship.

Figure 6:
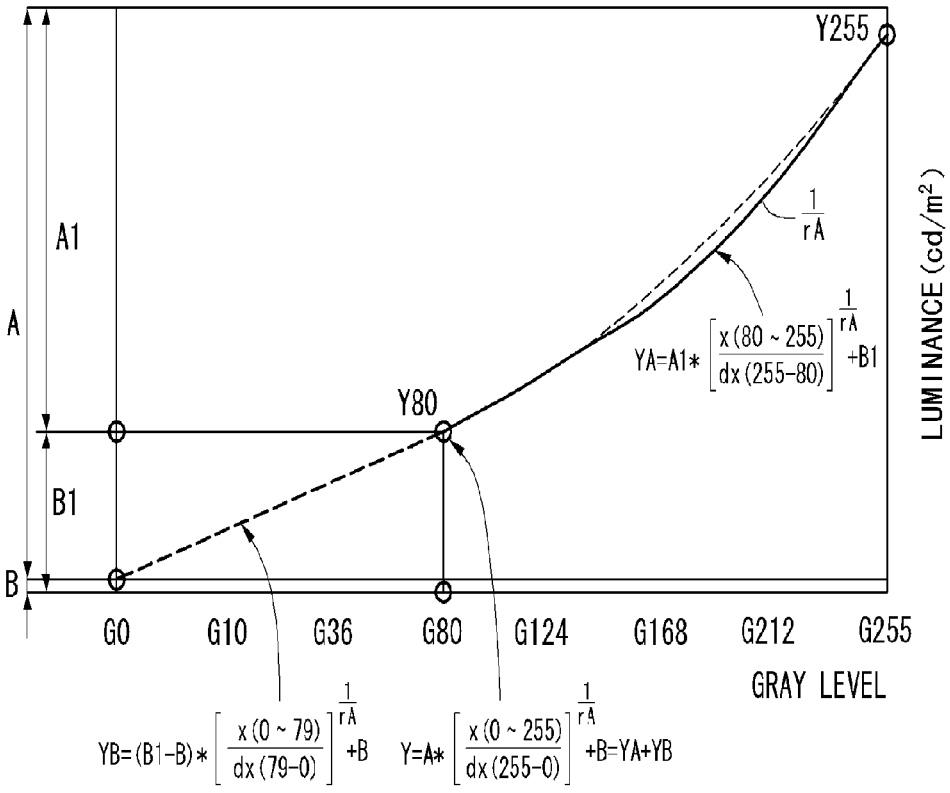
FIG. 6 is a diagram showing an accurate critical point setting method for deriving a critical point proportional factor when a critical point is non-conformal.
Figure 7:
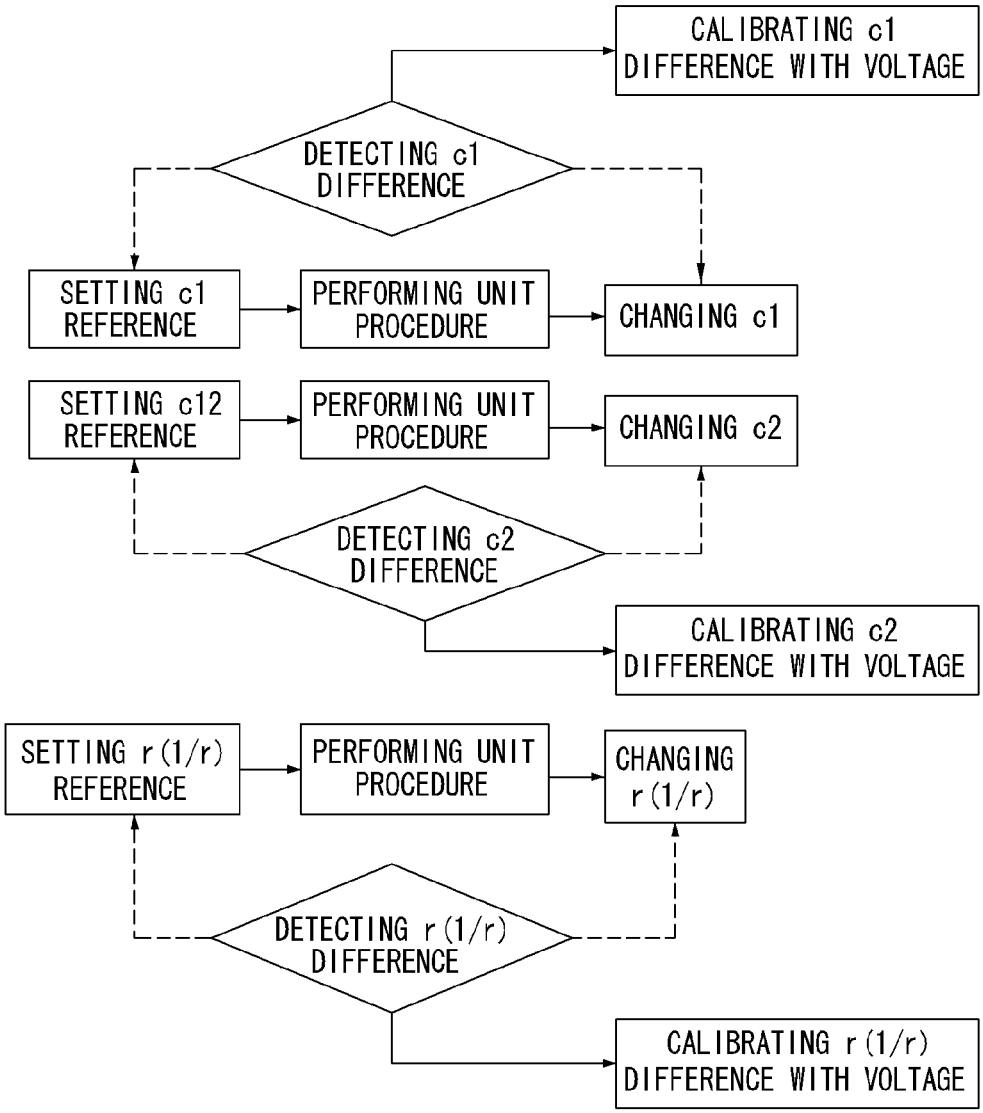
FIG. 7 is a diagram schematically illustrating the principle which calculates a calibration voltage using an efficiency proportional factor and a critical point proportional factor.

FIG. 5 shows the principle which derives the efficiency proportional factor "c1" and critical point proportional factor "c2" of the voltage transfer function and luminance transfer function. FIG. 6 shows an accurate critical point setting method for deriving a critical point proportional factor when a critical point is non-conformal. FIG. 7 schematically illustrates the principle which calculates a calibration voltage with the efficiency proportional factor "c1" and the critical point proportional factor "c2".

Referring to FIG. 5, a gain "a" of the voltage transfer function and an offset "b" of the voltage transfer function are divided with respect to a certain correlation point P between a high-level gamma source voltage VDDH and a low-level gamma source voltage VDDL that are applied to the data driving IC. Herein, the correlation point P acts as a reference point for organically connecting the correlation between the voltage transfer function and the luminance transfer function. In this case, the gain "a" of the voltage transfer function may be set within a certain range between the correlation point P and the low-level gamma source voltage VDDL, and the offset "b" of the voltage transfer function may be set within a range between the high-level gamma source voltage VDDH and the correlation P.

A gain A and offset B of the luminance transfer function may be set between a high-level cell driving voltage PVDD and a low-level cell driving voltage PVEE that are applied to the sub-pixels of a display panel, in which case the gain A and the offset B may be set within a range corresponding to the gain "a" of the voltage transfer function. The high-level cell driving voltage PVDD may be the substantially same as the high-level gamma source voltage VDDH, or have a level higher than that of the high-level gamma source voltage VDDH. The low-level cell driving voltage PVEE may have a level lower than that of the low-level gamma source voltage VDDL.

The efficiency proportional factor "c1" of FIG. 5 may be calculated from Equation (5) below.

$$(a*V)*c1=(A+B)*V1$$

$$c1=(A+B)*V1/(a*V) \quad (5)$$

where V is a bias voltage of the data driving IC and indicates a difference between the high-level gamma source voltage VDDH and the low-level gamma source voltage VDDL, and V1 is a voltage applied to the sub-pixels for driving OLEDs and indicates a difference between the high-level cell driving voltage PVDD and the low-level cell driving voltage PVEE.

Referring to Equation (5), the efficiency proportional factor "c1" is a correlation factor between input efficiency "a*V" and output efficiency "((A+B)*V1)". Since the efficiency proportional factor "c1" includes all variables between an input and an output as described above, the efficiency proportional factor "c1" is changed by a manufacturing process, aging, and the change of an ambient environment. The change of the efficiency proportional factor "c1" leads to the change of output luminance. When an input is "a" and an output is "A+B", an input value may be found from an input condition, and an output value may be found through measurement. The efficiency proportional factor "c1", being a correlation value between input and output values, may be arithmetically calculated with Equation (5). The present invention applies a changed efficiency proportional factor and desired target luminance to the voltage transfer function and the luminance transfer function, and thus converts a changed value of the efficiency proportional factor "c1" into a voltage to compensate for the changed value. In other words, as illustrated in FIG. 7, even when the efficiency proportional factor "c1" is changed by various variables that occur by performing a unit procedure and thus output luminance is changed from a desired value to another value, the present invention calibrates an input voltage by the changed amount of the efficiency proportional factor "c1" before and after the change, thereby maintaining output luminance at a desired level.

The critical point proportional factor "c2" of FIG. 5 may be calculated from Equation (6).

$$c2=B/c1+b \quad (6)$$

If desired to know the changed amount of the critical point of each product, the offset "b" value of the voltage transfer function may be found from an input condition, the offset "B" value of the luminance transfer function may be found through the measurement of a luminance critical point under the condition, and the efficiency proportional factor "c1" may be found from Equation (5). Therefore, the critical point proportional factor "c2" regarding the changes of the critical points of a driving TFT and OLED may be easily calculated from Equation (6). Since the critical point proportional factor "c2" includes all variables between an input and an output as described above, the critical point proportional factor "c2" is changed by a material characteristic difference, a pixel structure difference, a manufacturing process difference, an aging degree, the change of an ambient environment, mobility of a driving TFT, a parasitic capacitance difference or the like, for instance. Likewise with the efficiency proportional factor "c1", the critical point proportional factor "c2" may be applied to the voltage transfer function and the luminance transfer function, and thus converted into a voltage and compensated for by the changed value thereof. That is, as illustrated in FIG. 7, even when the critical point proportional factor "c2" is changed by various variables that occur by performing a unit procedure and thus output luminance is changed from a desired value to another value, the present invention calibrates an input voltage by the changed amount of the critical point proportional factor "c2", thereby maintaining output luminance as a desired value.

Likewise, as illustrated in FIG. 7, even when the slope factor "r" or "1/r" is changed by various variables that occur by performing a unit procedure and thus output luminance is changed from a desired value to another value, the present invention calibrates an input voltage by the changed amount of the slope factor "r" or "1/r", thereby maintaining output luminance as a desired value. Since the slope factors "r" and "1/r" are adjusted to match each other in a reciprocal relationship when performing target calibration, the present invention calculates a changed voltage slope factor "r" from a changed luminance slope factor "1/r" (which may be calculated from a luminance measurement value) by using the fact that the reciprocal relationship is continuously maintained even after the match, and calibrates an input voltage on the basis of the calculated slope factor.

In applying the present invention to an actual product, due to the non-uniformity of the critical point of an LTPS backplane driving element and the error of a measurement apparatus, the critical luminance characteristic of a low luminance transfer function contrasted with the low voltage transfer function is unstable and severely changes. Therefore, as shown in FIG. 6, the luminance transfer function may be divided into two sections, namely, a high luminance section "G80 to G255" and a low luminance section "G0 to G79" and used. Particularly, in the low luminance section "G0 to G79", since critical luminance directly affects the slope factor greatly, the critical luminance is maintained to have a few deviations for each product, but an actual measurement value shows a large deviation to the contrary. Therefore, the present invention separately generates a low luminance transfer function "YB" based on the characteristic of a high luminance transfer function "YA", and uses the low luminance transfer function "YB" when performing calibration in the low luminance section "G0 to G79". That is, when performing calibration in the low luminance section "G0 to G79", the present invention sets the low luminance section "G0 to G79" based on a total luminance transfer function "Y" without directly applying a deviation (which occurs in a product) to calibration and uses the low luminance section "G0 to G79" in a calibration stage, thus increasing the accuracy of calibration. As a method of generating the low luminance transfer function "YB", the following two methods are used.

A first method secures a slope "1/rA" and a critical point "B1" from a high luminance actual measurement curve, and generates the low luminance transfer function "YB" by using the slope "1/rA" (which is obtained from the high luminance actual measurement curve) as the slope of a low luminance curve, using the critical point "B" (which is obtained from the high luminance actual measurement curve) as the maximum luminance of a low luminance curve, and using the critical point "B" of target luminance as the critical point of the low luminance curve. The first method can be usefully used when a low luminance critical point is greatly changed.

A second method secures a slope "1/rA" and a critical point "B1" from a high luminance actual measurement curve, and generates the low luminance transfer function by using the slope "1/rA" (which is obtained from the high luminance actual measurement curve) as the slope of a low luminance curve, using the critical point "B" (which is obtained from the high luminance actual measurement curve) as the maximum luminance of a low luminance curve, and using estimation critical luminance (which is predicted from the high luminance actual measurement curve) as the critical point of the low luminance curve. The second method may be usefully used when the low luminance critical point is less changed but the error of a measurement apparatus greatly occurs in low luminance. The high luminance actual measurement curve provides maximum luminance "A+B", the slope "1/rA", and the critical point "B1", and thus, by applying a value (which is obtained from the high luminance actual measurement curve) to the total luminance transfer function "Y" and then calculating minimum luminance from a grayscale level "0", the estimation critical luminance can be seen.

The critical luminance becomes a reference point for obtaining a slope factor. Therefore, the critical luminance may be selectively calculated by one of the first and second methods depending on the case, but if the characteristic of a manufacturing process is stabilized, a relatively more accurate and approximate value can be obtained by the second method.

FIG. 6 shows that the first method of the two methods completes the low luminance curve by using target critical luminance. In FIG. 6, a dot line of the high luminance section "G80 to G255" is for showing that a slight error occurs between estimation high luminance and actual measurement high luminance by using target critical luminance "B" even when the same slope "1/rA" and a high luminance critical point "B1" are secured.

$$Y=A*[x(0\sim255)/dx(255-0)]^{1/rA}+B \quad (7)$$

Equation (7) is a numerical formula that expresses a general luminance transfer function. Herein, a critical point "B" is target critical luminance that is given in target luminance instead of an actual measurement value, or the estimation critical luminance of an estimation low luminance curve. The critical luminance sets the start points of measurement luminance curves. "Y" indicating a generally luminance transfer function is divided into a high luminance transfer function "YA" corresponding to the high luminance section "G80 to G255" and a low luminance transfer function "YB" corresponding to the low luminance section "G0 to G79" and used. In Equation (7), according to the first method, target luminance is converted and calculated into RGB luminance indicating white color in RGB color coordinates through white balance calibration in setting a target, and then "B" is determined as a value having minimum luminance thereof. "A" is a luminance gain that is obtained by subtracting the critical luminance "B" from maximum measurement luminance, and "1/rA" is an actual slope value of the high luminance transfer function "YA" based on measurement luminance. "x(0~255)" indicates one of grayscale levels "0 to 255", and "dx(255−0)" indicates 256 grayscale levels. A boundary (G80, Y80) between the high luminance transfer function "YA" and the low luminance transfer function "YB" may be changed to a reference point that is determined when setting a condition in a development stage, based on the reliability of measurement data.

The high luminance transfer function "YA" and the low luminance transfer function "YB" are expressed as Equation (8) below.

$$YA=A1*[(x(80\sim255)/dx(255-80)]^{1/rA}+B1,$$

$$YB=(B1-B)*[(x(0\sim79)/dx(79-0)]^{1/rA}+B,$$

$$A1=(A+B)-B1 \quad (8)$$

where "x(80~255)" indicates any one of 255 grayscale levels, and "dx(255 to 80)" indicates 136 grayscale levels. Also, "x(0~79)" indicates any one of grayscale levels "0 to 79", and "dx(79−0)" indicates 80 grayscale levels.

As expressed in Equation (8), the high luminance transfer function "YA" is used in the high luminance section "G80 to G255", and determined by an arbitrary measurement critical luminance "B1", a measurement luminance slope "1/rA", and a measurement maximum luminance gain "A1". The arbitrary measurement critical luminance "B1" is selected as a luminance level that enables the obtainment of a stable low luminance value in measurement luminance. The measurement luminance slope "1/rA" is a slope value of measurement luminance that is obtained in a luminance section higher than the arbitrary measurement critical luminance "B1". The measurement maximum luminance gain "A1" is determined as a value that is obtained by subtracting the stable measurement critical luminance "B1" from maximum luminance.

The low luminance transfer function "YB" is used in the low luminance section "G0 to G79", and determined by "B1" that is selected as one of target critical luminance and measurement critical luminance, the measurement luminance slope "1/rA", and a luminance gain "(B1−B)".

The high luminance transfer function "YA" and the low luminance transfer function "YB" are used selectively according to which of "x(80~255)" and "x(0~79)" a grayscale level corresponding to measurement luminance is included in. The stability of critical luminance characteristic can be effectively solved by the combination of the two Equations. The feature of the present invention cannot be realized by the existing lookup table scheme.

Figure 8:
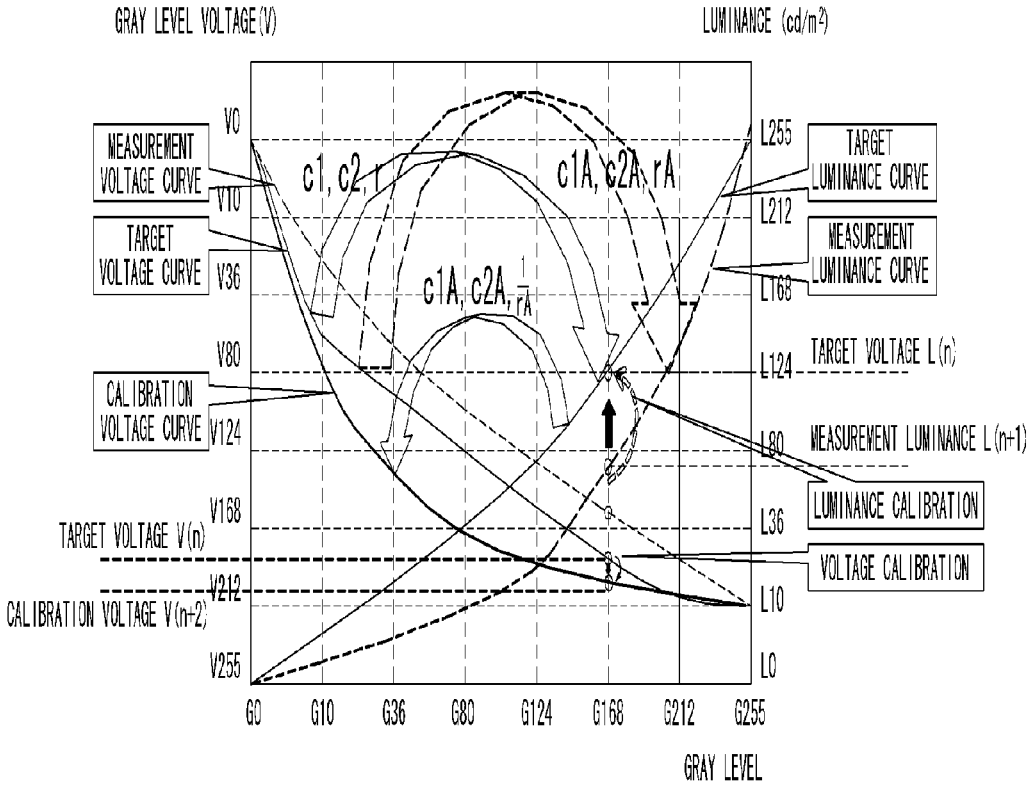
FIG. 8 is a diagram showing an example which calibrates a grayscale voltage in proportion to an amount of changed efficiency proportional factor, critical point proportional factor, and/or slope factor, for maintaining target luminance.

FIG. 8 shows an example which derives a difference between the transfer factors "c1", "c2" and "r" before and after change and calibrates a calibration voltage for maintaining target luminance (desired luminance), when changing output luminance based on a unit procedure.

Referring to FIG. 8, a target voltage "V(n)" is arbitrarily determined by an initial register value that has been decided in a product design and development stage, and a target luminance "L(n)" is determined by a color coordinate conversion formula based on white luminance, white coordinates, a gamma slope, RGB color coordinates, and white balance that have been obtained by a product development spec. Therefore, the target voltage "V(n)" and the target luminance "L(n)" are values that may be previously known before a calibration stage. When the target voltage "V(n)" and the target luminance "L(n)" have been decided, the efficiency proportional factor "c1" and the critical point proportional factor "c2" are calculated according to a numerical formula. When a relationship based on a transfer factor in the calculated maximum luminance, a relationship based on a transfer factor in the calculated critical luminance, and a transfer function relationship based on a slope in intermediate luminance match each other in a target calibration stage, a calibration difference is compensated for with a voltage difference and stored in a target register.

To perform calibration stages after target calibration, an operation is necessarily required for matching a slope factor "r" corresponding to the target voltage "V(n)" with a slope factor "1/r" corresponding to the target luminance "L(n)". A difference between two slopes is compensated for with a voltage difference, namely, a gamma voltage register though an operation that matches a luminance slope being the reciprocal of a voltage slope with the voltage slope being the reciprocal of the luminance slope. Such an operation is target calibration. The target calibration operation matches an initial register (which is secured in developing a product) or an arbitrary initial register value (which is built in the data driving IC) with a relationship "r=1/r", and thus obtains a target register value. The efficiency proportional factor "c1" and the critical point proportional factor "c2", which have been arithmetically obtained through the target calibration operation, forms an inverse function relationship "r=1/r" between the voltage transfer function and the luminance transfer function. Subsequent calibration operations are performed when the inverse function relationship "r=1/r" between the voltage transfer function and the luminance transfer function has been established.

The transfer factors "c1", "c2" and "r" change from initial reference values (values which are arbitrarily given in a target calibration stage) to "c1A", "c2A", and "rA" by various variables (for example, a manufacturing process, aging, the change of an ambient environment, etc.), and thus, a difference occurs between measurement luminance "L(n+1)" corresponding to the target voltage "V(n)" and the target luminance "L(n)". Therefore, the compensation of the target voltage "V(n)" is required to make the measurement luminance "L(n+1)" and the target luminance "L(n)" identical. In this case, the present invention calculates "c1A", "c2A", and "rA" using the measurement luminance "L(n+1)" and the target luminance "L(n)", and converts a difference between the transfer factors into a voltage value before and after change by applying "c1A", "c2A", "rA", and the target luminance "L(n)" to a transfer function. Herein, "rA" is a changed slope factor of the voltage transfer function, and can be easily obtained by calculating the reciprocal of the changed slope factor "1/rA" of the luminance transfer function that may be known from the measurement luminance. The present invention changes a gamma register using a converted voltage value to generate a calibration voltage "V(n+2)", and maintains the desired target luminance "L(n)" by applying the calibration voltage "V(n+2)" to a sub-pixel.

Calibrations after target calibration includes IR drop calibration, where the IR drop calibration is performed before calculating the transfer factors for obtaining a calibration voltage. The IR drop calibration of the present invention includes a line resistance IR drop calibration corresponding to static calibration, and data change amount IR drop calibration corresponding to dynamic calibration.

2. Calibration System for Adjusting Factor Value of Transfer Function and Operation Processing Thereof FIG. 9 is a diagram illustrating a calibration system for adjusting factor values of transfer functions and operation processing thereof.

Figure 9:
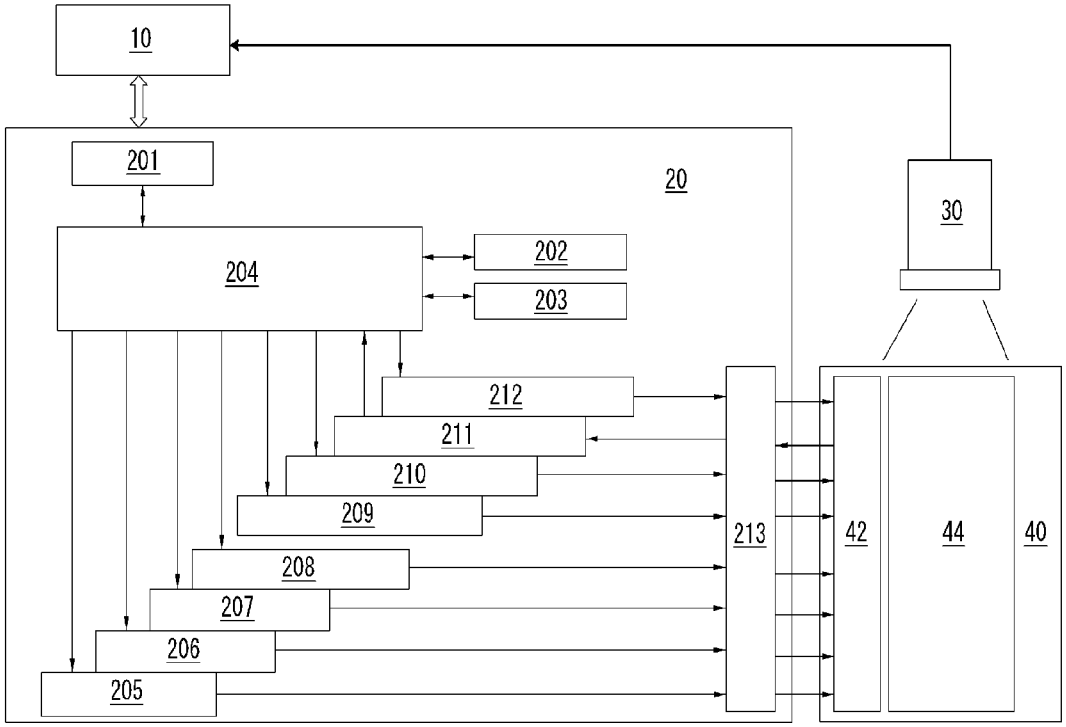
FIG. 9 is a diagram illustrating a calibration system for adjusting factor values of transfer functions and operation processing thereof.

Referring to FIG. 9, a calibration system according to an embodiment of the present invention includes a control center 10, a driving board 20, a luminance measurer 30, and an OLED display device 40.

The control center 10 may be a processor that supplies a work command signal for performing calibrations (target calibration, zero calibration, and auto calibration) by stage, to the driving board 20, for example, may be a Personal Computer (PC) in a manufacturing process, or may be a Mircro Computer Unit (MCU) in a complete product set. The control center 10 generates the work command signal to control a calibration operation such that a calibration work is performed with the voltage transfer function and the luminance transfer function even after the forwarding of a complete product as well as a manufacturing process. The control center 10 controls the operation timing of the luminance measurer 30, controls a data driving IC 42 such that a designated test pattern for luminance measurement is supplied to an OLED panel 44, and supplies luminance measurement data inputted from the luminance measurer 30 to the data driving IC 42 through the driving board 20. The control center 10 may directly supply the designated test pattern for luminance measurement to the OLED panel 44.

The driving board 20 includes a first interface 201, a target code memory 202, a default memory 203, a signal processing center 204, a PVDD/PVEE voltage generator 205, an IC voltage generator 206, a Multi Time Programmable (MTP) voltage generator 207, an initial code execution signal generator 208, a transfer function control data transferor 209, a target value/initial code data transferor 210, a target/default code data transferor 211, a luminance measurement data transferor 212, and a second interface 213.

The driving board 20 is manufactured independently from the control center 10. However, when the driving board 20 has been realized as a complete product set, the driving board may be integrated with the control center 10 and built in a system board.

The signal processing center 204 controls the PVDD/PVEE voltage generator 205, IC voltage generator 206, MTP voltage generator 207, initial code execution signal generator 208, transfer function control data transferor 209, target value/initial code data transferor 210, target/default code data transferor 211, luminance measurement data transferor 212, target code memory 202, and default memory 203 according to the control of the control center 10.

The signal processing center 204 supplies luminance measurement data inputted from the control center 10 to the data driving IC 42 through the second interface 212. The signal processing center 204 respectively stores a target code and a default code, which are inputted through the second interface 212, in the target code memory 202 and the default code memory 203. Unlike in FIGS. 9 and 10, the signal processing center 204 may further include a transfer function processing unit 406 for processing the voltage transfer function and the luminance transfer function. In this case, the signal processing center 204 may autonomously process luminance measurement data inputted from the control center 10, store a target code corresponding to the processed result in the target code memory 202, and store a default code corresponding to the processed result in the default code memory 203.

The PVDD/PVEE voltage generator 205 generates the cell driving voltages PVDD and PVEE necessary for driving of the OLED panel 44 according to the control of the control center 10.

The IC voltage generator 206 generates a logic voltage and gamma voltage necessary for the data driving IC 42, and a fundamental voltage including an OLED panel switch voltage, etc. according to the control of the control center 10.

The MTP voltage generator 207 supplies an MTP driving voltage to MTP memories, which are built in the data driving IC 42, at a designated point in time for MTP register down according to the control of the control center 10.

The initial code execution signal generator 208 generates an execution signal for setting an initial register value in initial driving of the data driving IC 42, according to the control of the control center 10. The initial register value is a register that is obtained based on the characteristic of a product in a development stage, and is a kind of initial code that is fundamentally supplied for using the same system.

The transfer function control data transferor 209 transfers control data (inputted from the control center 10) for transfer function processing to the data driving IC 42.

The target value/initial code data transferor 210 transfers the target value and initial code, inputted from the control center 10, to the data driving IC 42. The target value includes the high-level gamma source voltage VDDH, a low-level gamma source voltage VDDL, the high-level cell driving voltage PVDD, the low-level cell driving voltage PVEE, a target luminance value, a gamma slope value, and RGBW color coordinate values.

The target/default code data transferor 211 stores the target code and default code, inputted from the data driving IC 42, in the target code memory 202 and the default code memory 203 via the signal processing center 204. The target code is a code that is generated according to a result of target calibration that is performed with the transfer function. The default code is a code that is generated according to a result of zero calibration that is performed with the transfer function.

The first interface 201 interfaces a signal between the control center 10 and the driving board 20. The second interface 213 interfaces a signal between the driving board 20 and the data driving IC 42.

The luminance measurer 30 measures the output luminance of the OLED display device 40 for an RGBW test pattern and supplies the measured luminance to the control center 10. The control center 10 supplies input luminance measurement data to the data driving IC 42 through the driving board 20.

The OLED display device 40 will be described in detail with reference to FIGS. 10 to 22.

Figure 10:
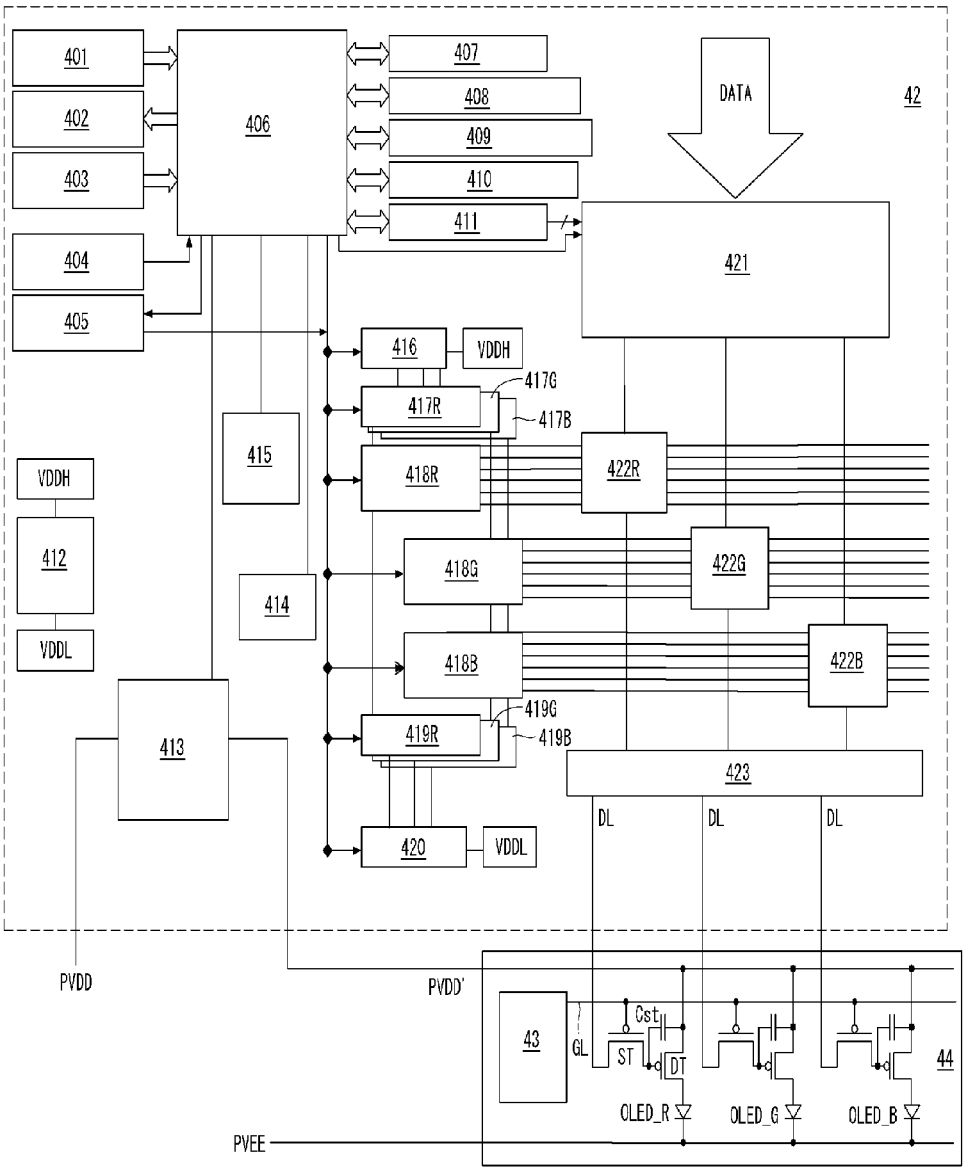
FIG. 10 is a diagram illustrating in detail an internal configuration of an OLED display device.
Figure 11A:
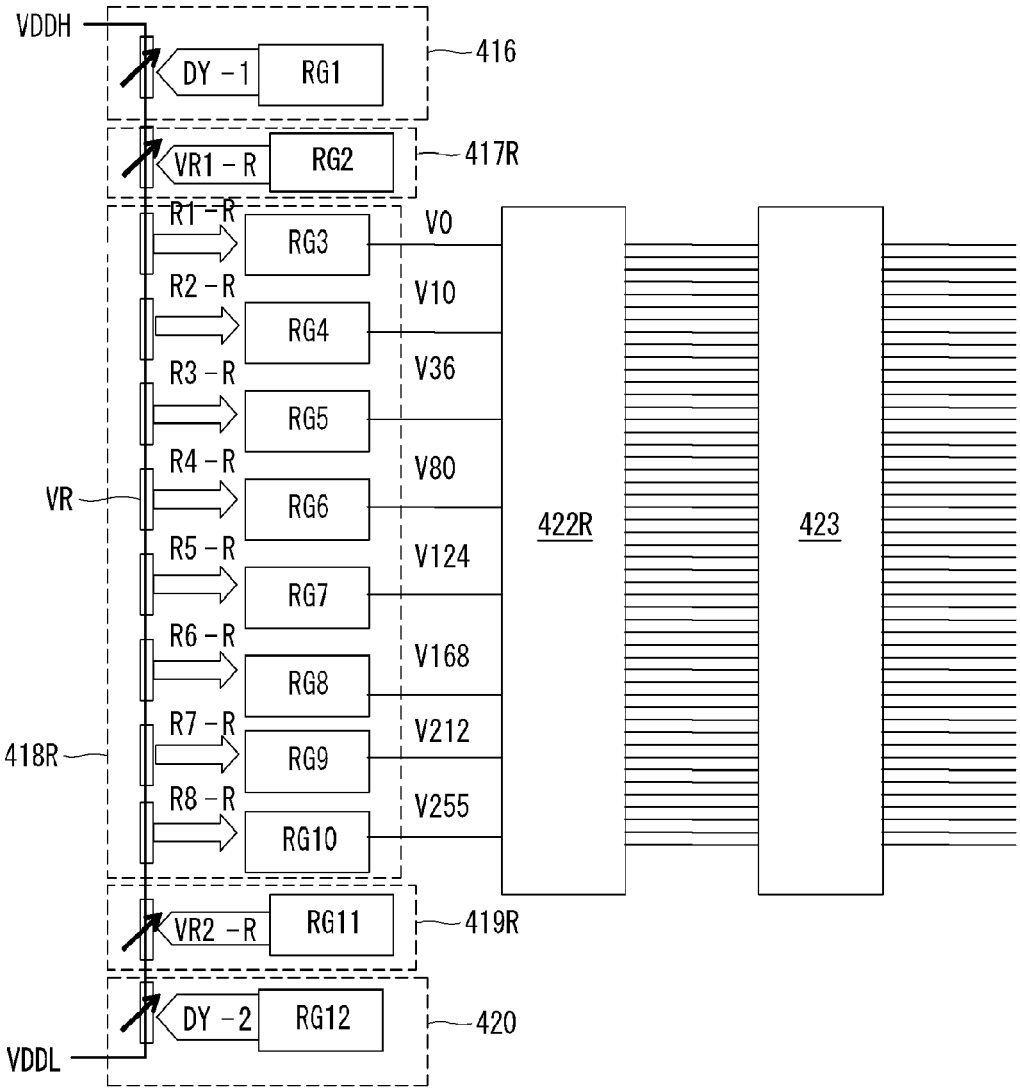
FIGS. 11A to 11C are diagrams illustrating grayscale voltage generation circuits for RGB, respectively.
Figure 11B:
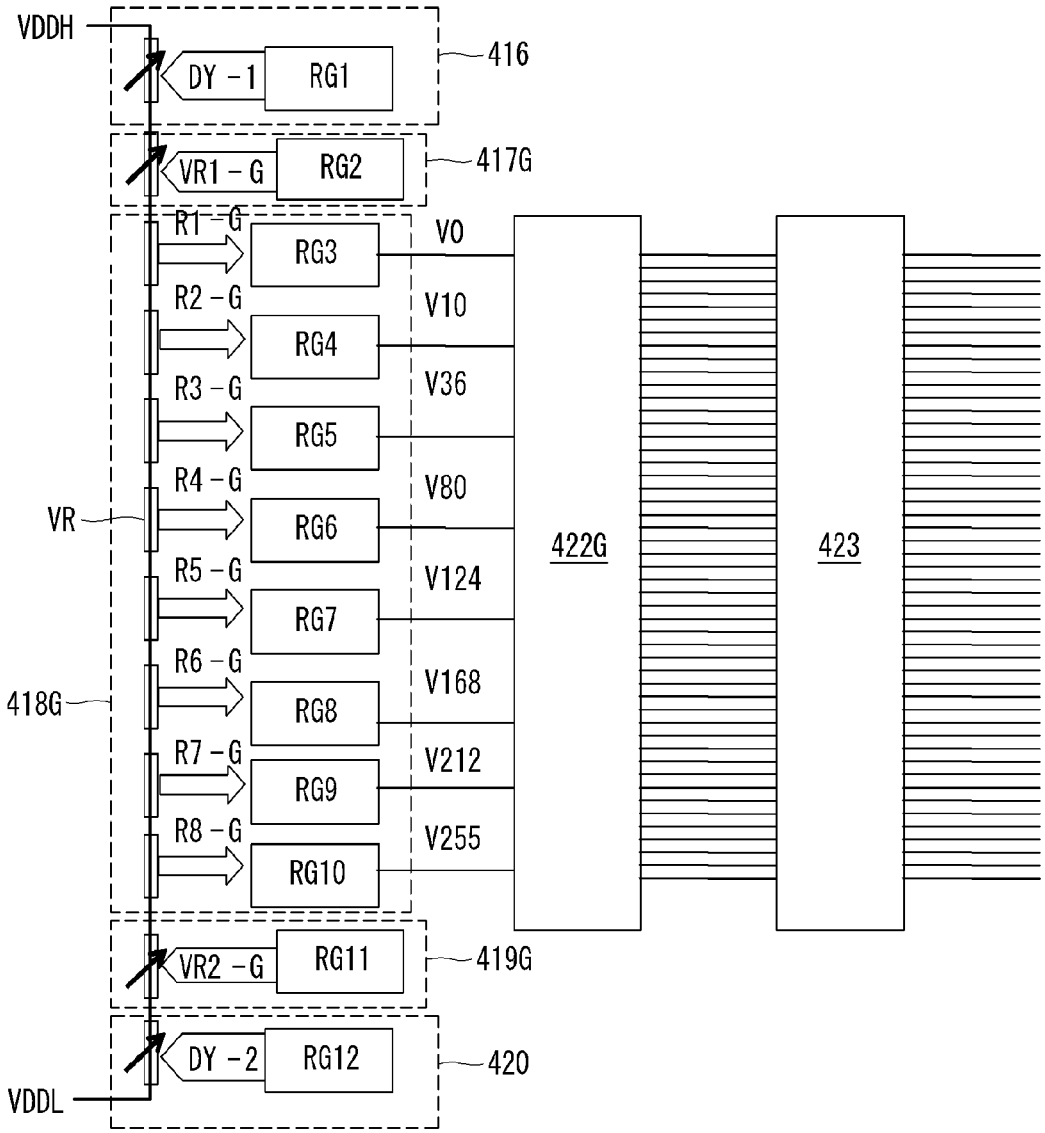
Figure 11C:
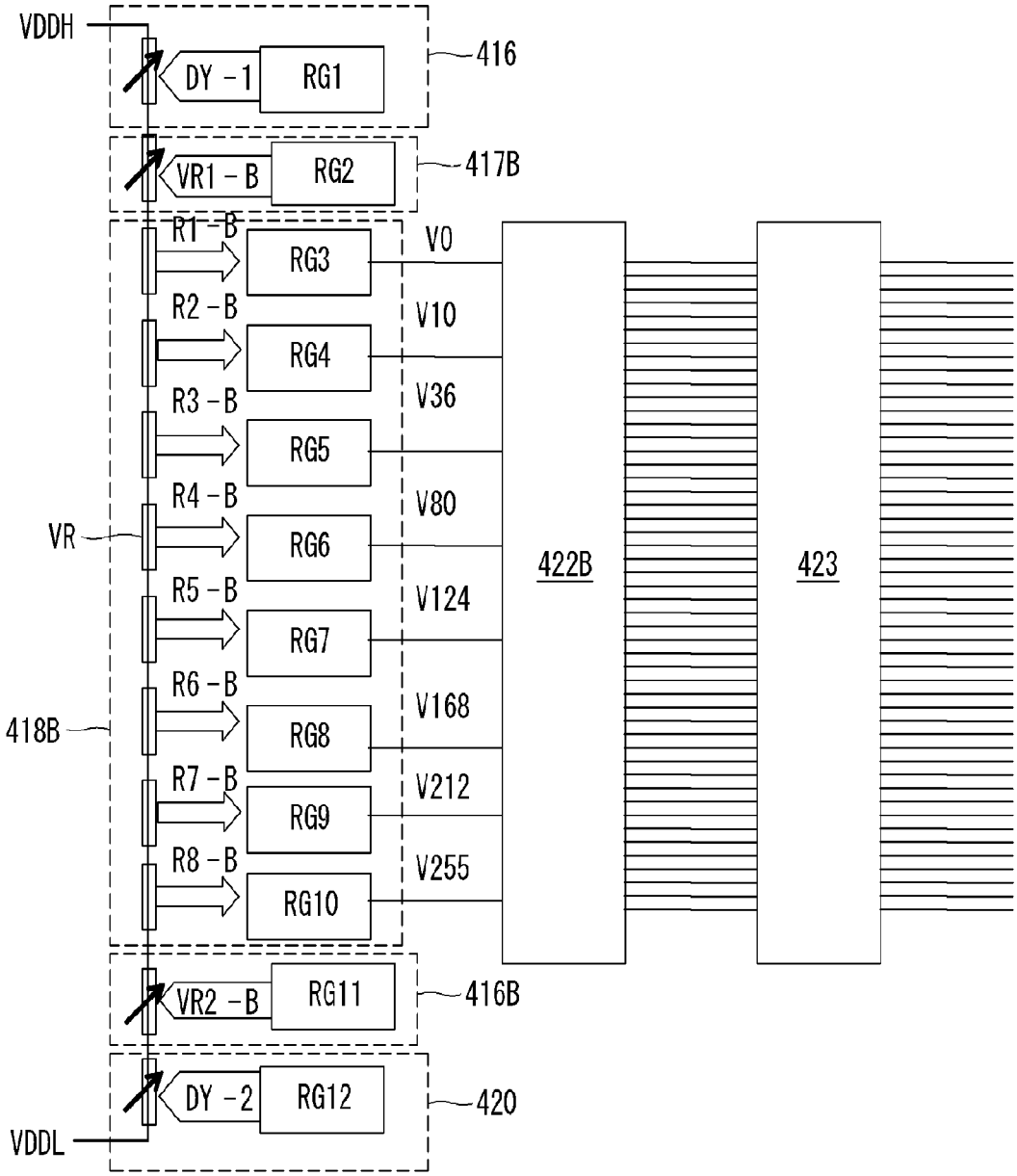
Figure 12:
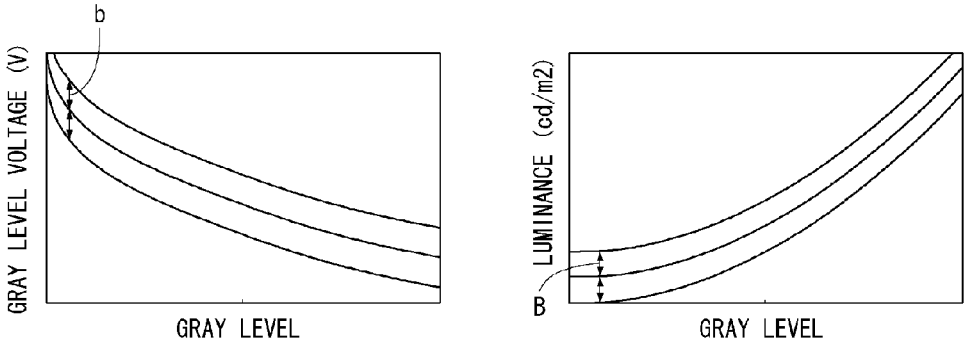
FIG. 12 is a diagram showing operation effects of offset adjustment units for RGB.
Figure 13:
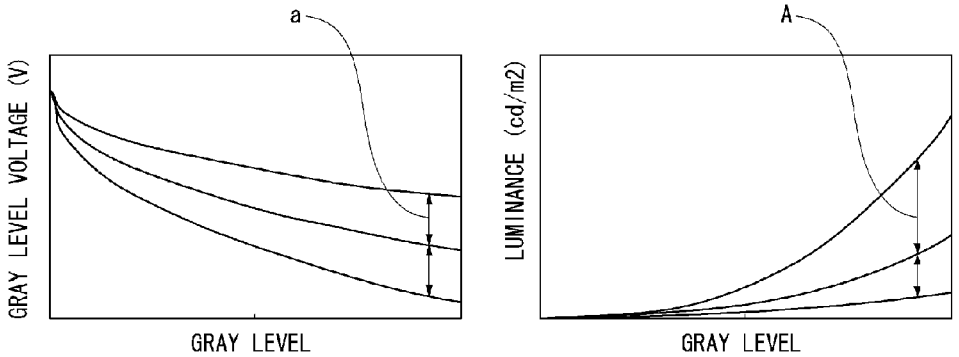
FIG. 13 is a diagram showing operation effects of gain adjustment units for RGB.
Figure 14:
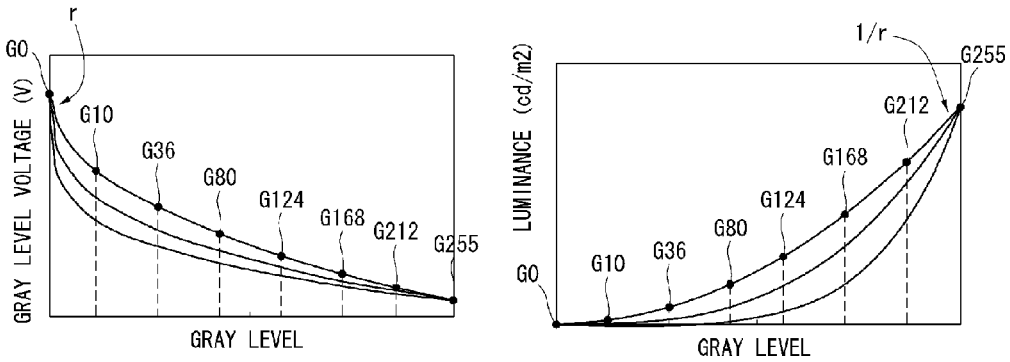
FIG. 14 is a diagram showing operation effects of gamma voltage adjustment units for RGB.

FIG. 10 illustrates the detailed internal configuration of the OLED display device 40. FIGS. 11A to 11C illustrate grayscale voltage generation circuits for RGB, respectively. FIG. 12 is a diagram showing operation effects of offset adjustment units for RGB. FIG. 13 is a diagram showing operation effects of gain adjustment units for RGB. FIG. 14 is a diagram showing operation effects of gamma voltage adjustment units for RGB.

Referring to FIG. 10, the OLED display device 40 includes the data driving IC 42 and the OLED panel 44.

The data driving IC 42 includes a luminance measurement data input unit 401, a target/default code output unit 402, a target value/initial code data input unit 403, a transfer function control data input unit 404, an initial code execution unit 405, a transfer function processing unit 406, an initial code data memory 407, a target/default register memory 408, an auto/aging register MTP memory 409, a reference source current value MTP memory 410, an RGB pattern generation unit 411, an IC driving voltage generation unit 412, a PVDD source current detection unit 413, a temperature detection unit 414, a light leakage current detection unit 415, a grayscale voltage generation circuit, an IR drop compensation unit 421, a plurality of decoder selectors 422R, 422G and 422B, and an output buffer 423.

The luminance measurement data input unit 401 processes luminance measurement data inputted from the driving board 20 and supplies the processed data to the transfer function processing unit 406.

The target/default code data output unit 402 receives target code data and default code data from the transfer function processing unit 406, and supplies the target code data and the default code data to the driving board 20.

The target value/initial code data input unit 403 transfers target luminance data and initial code data, inputted from the driving board 20, to the transfer function processing unit 406.

The transfer function control data input unit 404 supplies transfer function control data, inputted from the driving board 20, to the data driving IC 42.

The initial code execution unit 405 executes initial code data inputted from the driving board 20 to set an initial register value of the data driving IC 42. Various voltages for initial driving of the OLED panel 44, resolution, a driving timing, a gamma resistance setting value, etc. are set with the initial register value.

The transfer function processing unit 406 includes a transfer function algorithm for processing the voltage transfer function and the luminance transfer function, as a logic circuit, and performs an arithmetic operation for calibrations according to stages indicated by the control center 10. The transfer function processing unit 406 executes the transfer function algorithm for target calibration, zero calibration, auto calibration, aging calibration to calculate the transfer factors (efficiency proportional factor, critical point proportional factor, and slope factor), derives a voltage difference that is to be compensated for by a transfer function arithmetic operation using the calculated result, and changes the setting values of RGB gamma registers in response to the derived voltage difference. The transfer function processing unit 406 executes the transfer function algorithm to change a setting value of a dynamic register for adjusting the level of a gamma source voltage, in performing environment calibration. The transfer function processing unit 406 performs a static IR drop compensation operation that is illustrated in FIGS. 18 to 21. The transfer function processing unit 406, unlike in FIG. 10, may be built in the signal processing center 204 of the driving board 20.

The initial code data memory 407 stores initial code data inputted through the target value/initial code data input unit 404.

The target/default register memory 408 sequentially stores a target register and a default register, corresponding to RGB gamma registers that are changed according to the results of target calibration and zero calibration that are performed by the transfer function processing unit 406.

The auto/aging register MTP memory 409 stores RGB gamma register values, which are to be changed according to a result of auto calibration that is performed by the transfer function processing unit 406, as an auto register. The auto/aging register MTP memory 409 stores RGB gamma register values, which are to be changed according to a result of aging calibration that is performed by the transfer function processing unit 406, as an aging register.

The reference source current value MTP memory 410 stores a luminance-current ratio value that is set for each of eight grayscale patterns for each of RGB in performing zero calibration. The luminance-current ratio value is set by the PVDD source current detection unit 413.

The RGB pattern generation unit 411 generates test patterns that are respectively used for calibrations (zero calibration, auto calibration, and aging calibration) according to the control of the control center 10 or receives test patterns from the control center 10, and then applies the generated test patterns to the OLED panel 44. Each of the test patterns indicates data that is used for luminance measurement at a voltage-luminance connection point between gray scales.

The IC driving voltage generation unit 412 level-shifts a voltage of the IC voltage generator 206, inputted from the driving board 20, to generate the high-level gamma source voltage VDDH and the low-level gamma source voltage VDDL for driving the gamma resistors of the grayscale voltage generation circuit.

The PVDD source current detection unit 413 is for aging calibration. Aging calibration is for converting a current change difference, caused by the reduction in service life, into a luminance difference. In performing zero calibration, the PVDD source current detection unit 413 stores the luminance-current ratio value in the reference source current MTP memory 410 on the basis of a current value that flows through a supply line for the high-level cell driving voltage PVDD in target luminance of each grayscale level, and thereafter when luminance decreases due to the reduction in service life, the reference source current MTP memory 410 senses an amount of decreased current due to the increase in a resistance in each grayscale level. The present invention increases a voltage by an amount of decreased current due to the reduction in service life and thus matches a current, flowing through the supply line, with a reference current value in performing zero calibration. A detailed configuration of the PVDD source current detection unit 413 will be described below with reference to FIG. 15.

The temperature detection unit 414 and the light leakage current detection unit 415 are for environment calibration. Among environment calibration, temperature calibration is for responding to the change of an ambient temperature and the change of an operating temperature due to an internal influence. The change of the ambient temperature is almost reflected in setting an initial reference point and thus does not cause the great change, but the change of an internal operation continuously increases in proportion to the elapse of an operating time. The temperature detection unit 414 is disposed inside the data driving IC 42 to sense the heat energy that is transferred from the direct heat generating portion of the OLED panel 44 to the data driving IC 42, and thus easily detects the continuous and entire change of a temperature compared to the immediate and sensitive increase/decrease in the temperature. In the present invention, temperature calibration increases the low-level gamma source voltage VDDL when a temperature rises and thus decreases total consumption power (in the P-type LTPS backplane), thereby reducing internally-generated heat through moderate and continuous calibration. However, due to temperature calibration, the size of total power may decrease and a critical point may be lowered, and consequently, temperature calibration may be performed together with critical point calibration.

Light leakage current calibration is calibration for preventing low luminance data from being lost due to the rising of a critical point, caused by the rising of a temperature or light, in a backplane driving device. The critical point decreases in proportion to the increase in a light leakage current (P-type), and thus, light leakage current calibration reduces the entire size of a voltage curve by lowering the high-level gamma source voltage VDDH (being a low luminance voltage) of a voltage transfer curve. Light leakage current calibration is more required for the moderate and continuous change than the rapid change. A light leakage current is greater affected by external ambient light and an internal temperature than internal light, and thus, the light leakage current detection unit 415 may be disposed inside the data driving IC 42 so as to detect the continuous change.

For environment calibration, an environment calibration response speed based on the detection of an environment factor, detection sensitivity, and the maximum and minimum limit points of voltage calibration are required to be set previously. The temperature detection unit 414 and the light leakage current detection unit 415 will be described below with reference to FIGS. 16 and 17.

When the setting values of RGB gamma registers based on a result of calibration are changed or the setting value of a dynamic register is changed, the grayscale voltage generation circuit changes a grayscale voltage according to the change. The grayscale voltage generation circuit includes a DY1 adjustment unit 416, a plurality of R gamma adjustment units 417R, 418R and 419R, a plurality of G gamma adjustment units 417G, 418G and 419G, a plurality of B gamma adjustment units 417B, 418B and 419B, and a DY2 adjustment unit 420.

The DY1 adjustment unit 416, as illustrated in FIGS. 11A to 11C, includes a first dynamic resistor DY-1 connected to a high-level gamma source voltage VDDH terminal, and a first dynamic register RG1. The DY1 adjustment unit 416 adjusts an input level of the high-level gamma source voltage VDDH in response to the change of a resistance value of the first dynamic resistor DY-1 based on the first dynamic register RG1.

The DY2 adjustment unit 420, as illustrated in FIGS. 11A to 11C, includes a second dynamic resistor DY-2 connected to a low-level gamma source voltage VDDL terminal, and a second dynamic register RG12. The DY2 adjustment unit 420 adjusts an input level of the low-level gamma source voltage VDDL in response to the change of a resistance value of the second dynamic resistor DY-2 based on the second dynamic register RG12.

The R gamma adjustment units 417R, 418R and 419R include an R offset adjustment unit 417R, an R gamma voltage adjustment unit 418R, and an R gain adjustment unit 419R that are connected between the DY1 adjustment unit 416 and the DY2 adjustment unit 420.

The R offset adjustment unit 417R, as illustrated in FIG. 11A, includes an R offset resistor VR1-R and an R offset register RG2. The R offset adjustment unit 417R, as shown in FIG. 12, adjusts an offset "b" of the voltage transfer function and an offset "B" of the luminance transfer function in response to the change of a resistance value of the R offset resistor VR1-R based on the R offset register RG2.

The R gain adjustment unit 419R, as illustrated in FIG. 11A, includes an R gain resistor VR2-R and an R gain register RG11. The R gain adjustment unit 419R, as shown in FIG. 13, adjusts a gain "a" of the voltage transfer function and a gain "A" of the luminance transfer function in response to the change of a resistance value of the R gain resistor VR2-R based on the R gain register RG11.

The gamma voltage adjustment unit 418R, as illustrated in FIG. 11A, includes a plurality of slope variable resistors R1-R to R8-R and R gamma registers RG3 to RG10 connected between the R offset adjustment unit 417R and the R gain adjustment unit 419R.

The R gamma registers RG3 to RG10 are gamma slope adjustment registers, and adjust the levels of gamma reference voltages V0, V10, V36, V80, V124, V168, V212 and V255 in respective eight points.

The R gamma voltage adjustment unit 418R, as shown in FIG. 14, adjusts the slope "r" of the voltage transfer function and the slope "1/r" of the luminance transfer function in response to the change of resistance values of the respective R slope variable resistors R1-R to R8-R based on the gamma registers RG3 to RG10.

The R gamma voltage adjustment unit 418R additionally divides the gamma reference voltages V0, V10, V36, V80, V124, V168, V212 and V255 with adjusted slopes to output final gamma voltages V0 to V255, by using internally predetermined gamma voltage dividing resistors (not shown).

The G gamma adjustment units 417G, 418G and 419G include a G offset adjustment unit 417G, a G gamma voltage adjustment unit 418G, and a G gain adjustment unit 419G that are connected between the DY1 adjustment unit 416 and the DY2 adjustment unit 420. The G gamma adjustment units 417G, 418G and 419G of FIG. 11B have a configuration substantially similar to the above-described R gamma adjustment units, and thus, their detailed description is not provided.

The B gamma adjustment units 417B, 418B and 419B include a B offset adjustment unit 417B, a B gamma voltage adjustment unit 418B, and a B gain adjustment unit 419B that are connected between the DY1 adjustment unit 416 and the DY2 adjustment unit 420. The B gamma adjustment units 417B, 418B and 419B of FIG. 11C have a configuration substantially similar to the above-described R gamma adjustment units, and thus, their detailed description is not provided.

The IR drop compensation unit 421 compensates for dynamic IR drop due to an amount of changed data. The IR drop compensation unit 421 receives digital image data equal to the total number of sub-pixels, where static IR drop due to line resistance differences by position has been compensated for, to compensate for dynamic IR drop and thereafter supplies the digital image data to a plurality of decoder selectors 422R, 422G and 422B. Alternatively, the IR drop compensation unit 421 receives respective digital image data being RGB test patterns and supplies the respective digital image data to the decoder selectors 422R, 422G and 422B. The IR drop compensation unit 421 will be below described in detail with reference to FIG. 11.

The decoder selectors 422R, 422G and 422B include an R decoder selector 422R, a G decoder selector 422G, and a B decoder selector 422B.

The R decoder selector 422R maps R digital data, inputted from the IR drop compensation unit 421, to final gamma voltages V0 to V255 inputted from the R gamma voltage adjustment unit 418R to convert the R digital data into an analog gamma voltage, and generates the analog gamma voltage as an R data voltage.

The G decoder selector 422G maps G digital data, inputted from the IR drop compensation unit 421, to final gamma voltages V0 to V255 inputted from the G gamma voltage adjustment unit 418G to convert the G digital data into an analog gamma voltage, and generates the analog gamma voltage as a G data voltage.

Likewise, the B decoder selector 422B maps B digital data, inputted from the IR drop compensation unit 421, to final gamma voltages V0 to V255 inputted from the B gamma voltage adjustment unit 418B to convert the B digital data into an analog gamma voltage, and generates the analog gamma voltage as a B data voltage.

The output buffer 423 stabilizes the output of RGB data voltages, and then respectively supplies the RGB data voltages to the data lines DL of the OLED panel 44.

The OLED panel 44 acts as display panel for displaying an image. The OLED panel 44 may include a cell array that is formed in an effective active area, and a gate driving circuit 43 that is formed in an inactive area outside of the effective active area. The cell array is the substantially same as the description of FIG. 3.

Figure 32:
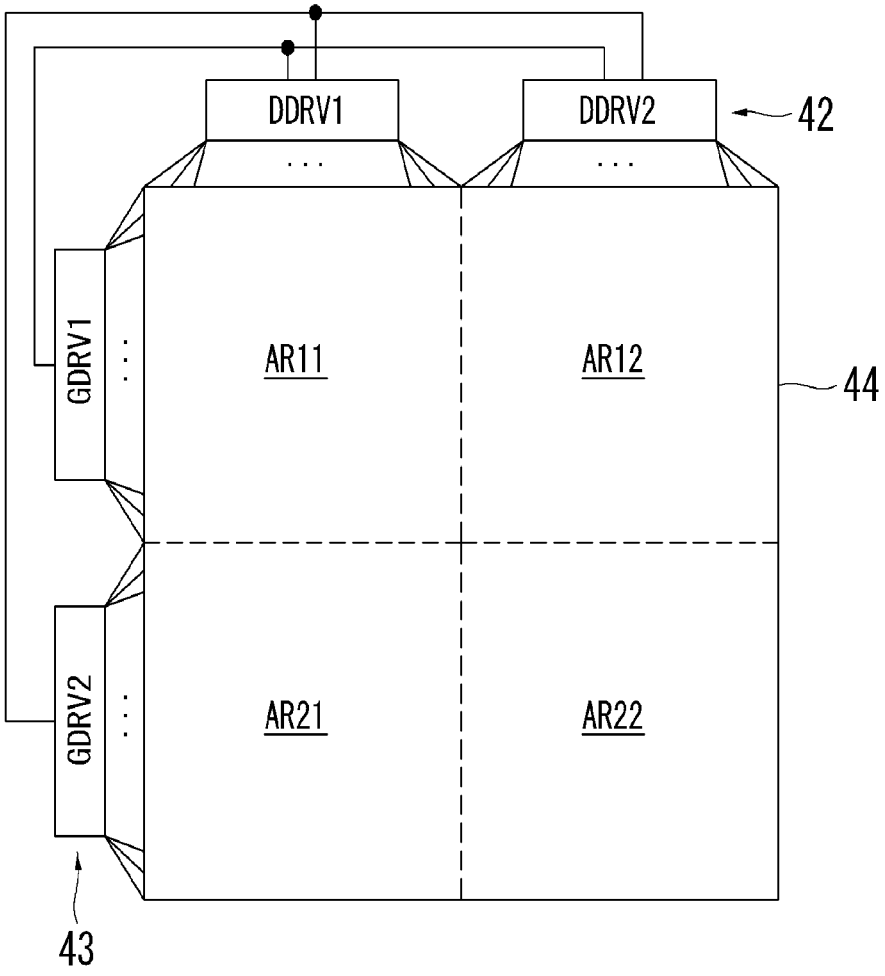
FIG. 32 is a diagram illustrating an example for effectively solving IR drop in a large-area screen.

The gate driving circuit 43 generates a scan pulse that swings between a gate high voltage for turning on a switch TFT ST in a cell and a gate low voltage for turning off the switch TFT ST. The gate driving circuit 43 supplies the scan pulse to the gate lines GL to drive the gate lines GL sequentially, and thus selects a horizontal line of a cell array that will receive a data voltage. The gate driving circuit 43, as illustrated, may be provided in the OLED panel 44 according to a gate driver IC in panel (GIP) type. Also, as illustrated in FIG. 32, when an OLED panel 44 has a large area, the gate driving circuit 43 may be connected to gate lines outside the OLED panel 44 through a Tape Automated Bonding (TAB) process.

Figure 15:
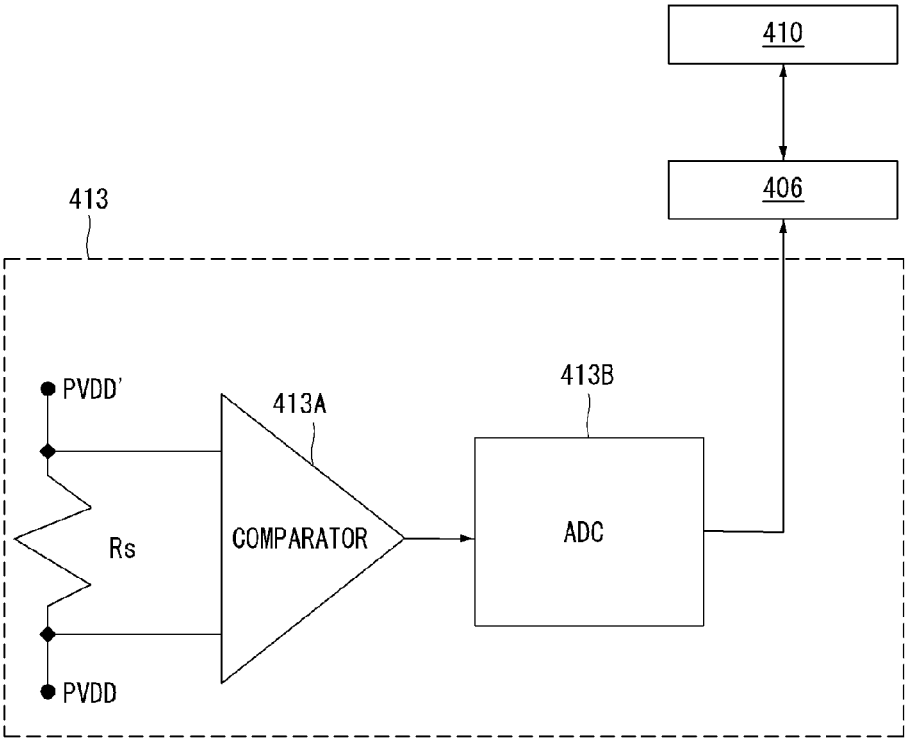
FIG. 15 is a diagram illustrating a detailed configuration of a source current detection unit.

FIG. 15 is a diagram illustrating a detailed configuration of the PVDD source current detection unit 413.

Referring to FIG. 15, the PVDD source current detection unit 413 is for aging calibration, and senses the change of a high-level cell driving voltage PVDD that is applied to the OLED panel 44. For this end, the PVDD source current detection unit 413 includes a comparator 413A that senses a current flowing through a supply line for the high-level cell driving voltage PVDD, and an analog-to-digital converter (ADC) 413B that analog-to-digital converts a sensing current from the comparator 413A.

In FIG. 15, PVDD' indicates a high-level cell driving voltage, and Rs indicates a sensing resistor for sensing a current.

In a zero calibration stage where predetermined luminance is adjusted to be displayed according to a predetermined test pattern, the transfer function processing unit 406 pre-stores a detection source current value, inputted from the ADC 413B, as a reference source current value in the reference source current value MTP memory 410. In performing aging calibration, the transfer function processing unit 406 calibrates a luminance value corresponding to the detection source current value inputted from the ADC 413B according to the predetermined test pattern, on the basis of a luminance-current ratio value pre-stored in the reference source current value MTP memory 410. Furthermore, the transfer function processing unit 406 changes register resistance values of cell driving voltages for each of RGB on the basis of the calibrated luminance value in response to a command signal from the control center 10, for aging calibration.

Figure 16:
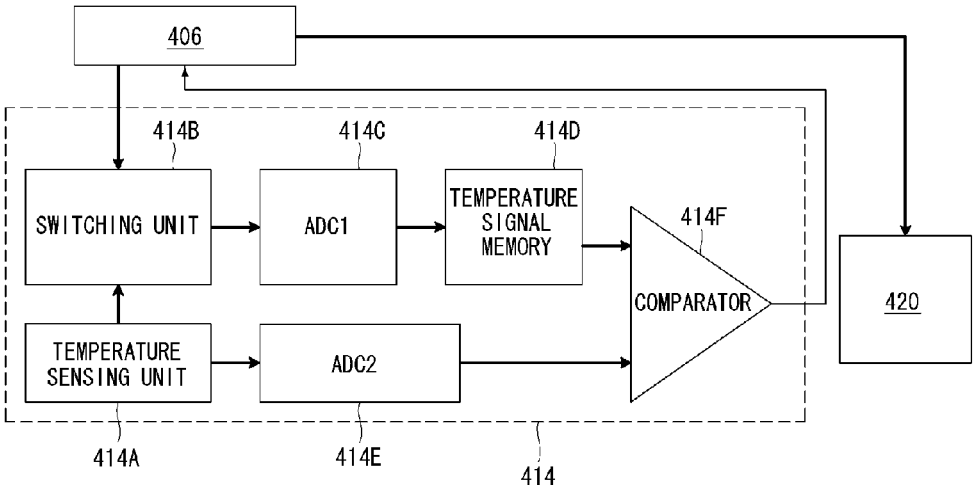
FIG. 16 is a diagram illustrating a detailed configuration of a temperature detection unit.

FIG. 16 is a diagram illustrating a detailed configuration of the temperature detection unit 414.

Referring to FIG. 16, the temperature detection unit 414 is for calibrating a driving condition that is changed by the change of the ambient temperature, and compares a sensed temperature with a predetermined initial value to supply the compared result to the transfer function processing unit 406. The temperature detection unit 414 includes a temperature sensing unit 414A, a switching unit 414B, a first ADC 414C, a temperature signal memory 414D, a second ADC 414E, and a comparator 414F.

The temperature sensing unit 414A includes a temperature sensor, and senses the temperature of the OLED display device 40.

The switching unit 414B is turned on for a certain time period after the OLED display device 40 is normally driven, and supplies a temperature sensing value, inputted from the temperature sensing unit 414A, as a reference temperature value to the first ADC 414C. Herein, a start point and duration of the certain time period may be changed depending on the case, and controlled by the transfer function processing unit 406.

The first ADC 414C analog-to-digital converts the reference temperature value, and stores the digital reference temperature value in the temperature signal memory 414D.

The second ADC 414E analog-to-digital converts the temperature sensing value, continuously inputted from the temperature sensing unit 414A, as a current temperature value. Depending on the case, the first ADC 414C and the second ADC 414E may be replaced with one ADC and one switch that switches the output of the one ADC.

The comparator 414F compares a reference temperature value and the current temperature value, and supplies the compared result to the transfer function processing unit 406. Therefore, the transfer function processing unit 406 controls the DY2 adjustment unit 420 to adjust the input level of the low-level gamma source voltage VDDL, in response to a command signal from the control center 10.

When a transfer function factor is changed and thus output luminance is changed by an internal temperature or an ambient temperature due to the operation for long periods of time, calibration for target luminance can be performed by adjusting the input level of the low-level gamma source voltage VDDL. The rising of a temperature increases light emission efficiency and consumption power, and decreases service life. To calibrate this, by maintaining the entire characteristic of a gamma resistance curve and increasing the level of a low-level gamma voltage (i.e., decreasing the size of a voltage difference), an amount of consumed current is reduced, and thus, a temperature falls to a reference point, thereby extending normal service life. An influence of an ambient temperature for a normal operation time and a self-heating value in a fundamental operation are reflected in the reference point.

Figure 17:
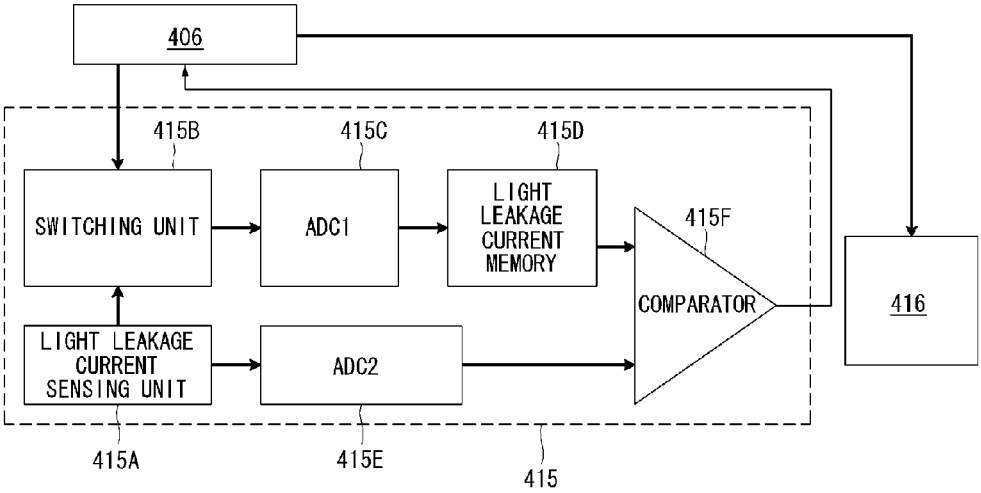
FIG. 17 is a diagram illustrating a detailed configuration of a light leakage current detection unit.

FIG. 17 is a diagram illustrating a detailed configuration of the light leakage current detection unit 415.

Referring to FIG. 17, the light leakage current detection unit 415 is for compensating for a low gray scale that is not realized by an off current due to a light leakage current generated in the driving TFT DT of the OLED panel 44, and compares a sensed light leakage current with an initial value to supply the compared result to the transfer function processing unit 406. The light leakage current detection unit 415 includes a light leakage current sensing unit 415A, a switching unit 415B, a first ADC 415C, a light leakage current memory 415D, a second ADC 415E, and a comparator 415F.

The light leakage current sensing unit 415A includes a current sensor L, and senses the light leakage current of the driving TFT DT.

The switching unit 415B is turned on for a certain time period after the OLED display device 40 is normally driven, and supplies a light leakage current sensing value, inputted from the light leakage current sensing unit 415A, as a reference leakage current value to the first ADC 415C. Herein, a start point and duration of the certain time period may be changed depending on the case, and controlled by the transfer function processing unit 406.

The first ADC 415C analog-to-digital converts the reference leakage current value, and stores the digital reference leakage current value in the light leakage current memory 415D.

The second ADC 415E analog-to-digital converts the light leakage current sensing value, continuously inputted from the light leakage current sensing unit 415A, as a current leakage current value. Depending on the case, the first ADC 415C and the second ADC 415E may be replaced with one ADC and one switch that switches the output of the one ADC.

The comparator 415F compares a reference leakage current value and the current leakage current value, and supplies the compared result to the transfer function processing unit 406. Therefore, the transfer function processing unit 406 controls the DY1 adjustment unit 417 to adjust the input level of the high-level gamma source voltage VDDH, in response to a command signal from the control center 10.

When a low gray scale close to a critical point is not normally realized by a light leakage current, a voltage close to the critical point of an operation current is changed by adjusting the input level of the high-level gamma source voltage VDDH, and thus, the low gray scale can be realized. The main purpose of calibration for a light leakage current maintains a voltage relationship or characteristic based on total gamma resistors as-is and decreases a critical voltage, for preventing loss in displaying low luminance due to the drop of the critical point that is caused by external light or the rising of a temperature (corresponding to P-type).

Figure 18:
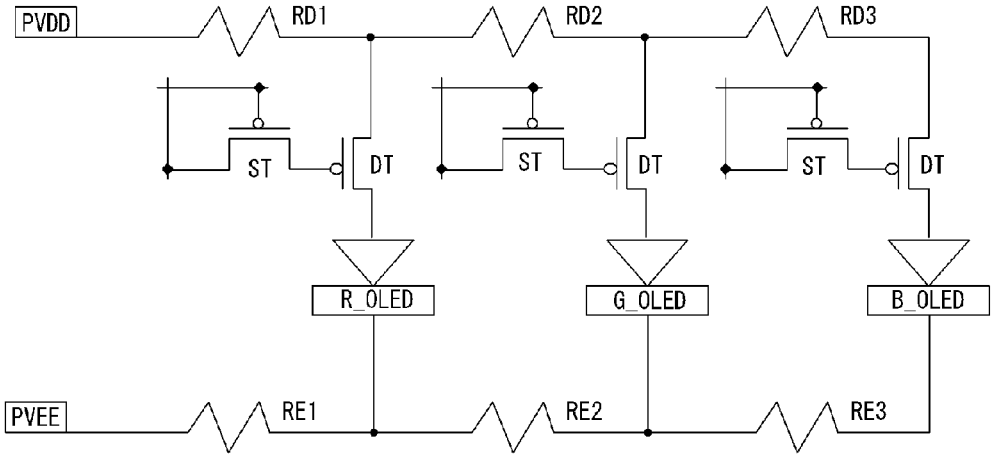
FIG. 18 is a diagram illustrating a cause of static IR drop due to a difference in the line resistance caused by respective positions of a power supply line.

FIG. 18 is a diagram illustrating a cause of static IR drop due to a difference in line resistance caused by respective positions of a power supply line.

As illustrated in FIG. 18, a plurality of line resistors RD1, RD2, RD3, RE1, RE2 and RE3 are disposed in a supply line (which is formed in the OLED panel 44) for a cell driving voltage. The line resistors RD1, RD2, RD3, RE1, RE2 and RE3 cause static IR drop. In zero calibration, auto calibration, and aging calibration stages, when performing gamma calibration, only static IR drop due to a line resistor is targeted in the white state where RGB data reaches the maximum value.

The efficiency proportion factor "c1", as described above, includes all changed factors between an input voltage and output luminance. Static IR drop occurring for the same input voltage is included in the efficiency proportion factor "c1", and the change of output luminance due to static IR drop has a proportional relationship with the change of the efficiency proportion factor "c1" for each gray scale. Static IR drop when RGB data are separately driven and static IR drop when the RGB data are driven simultaneously are obtained at the same voltage condition, and, thus, are proportional to each other. If the proportional relationship of the efficiency proportion factor "c1" is calculated for each gray scale through luminance measurement, the efficiency proportion factor "c1" may be used in the proportional relationship of static IR drop. Maximum IR drop is obtained by a proportional relationship between separate driving of RGB data and simultaneous driving of RGB data, and reflected in gamma calibration as static IR drop due to a line resistor in zero calibration, auto calibration, and aging calibration stages. Dynamic IR drop due to an amount of changed RGB data is obtained on the basis of an analyzed result of input data, and reflected in the input data by the IR drop compensation unit 421 of FIG. 10 in real time.

Figure 19:
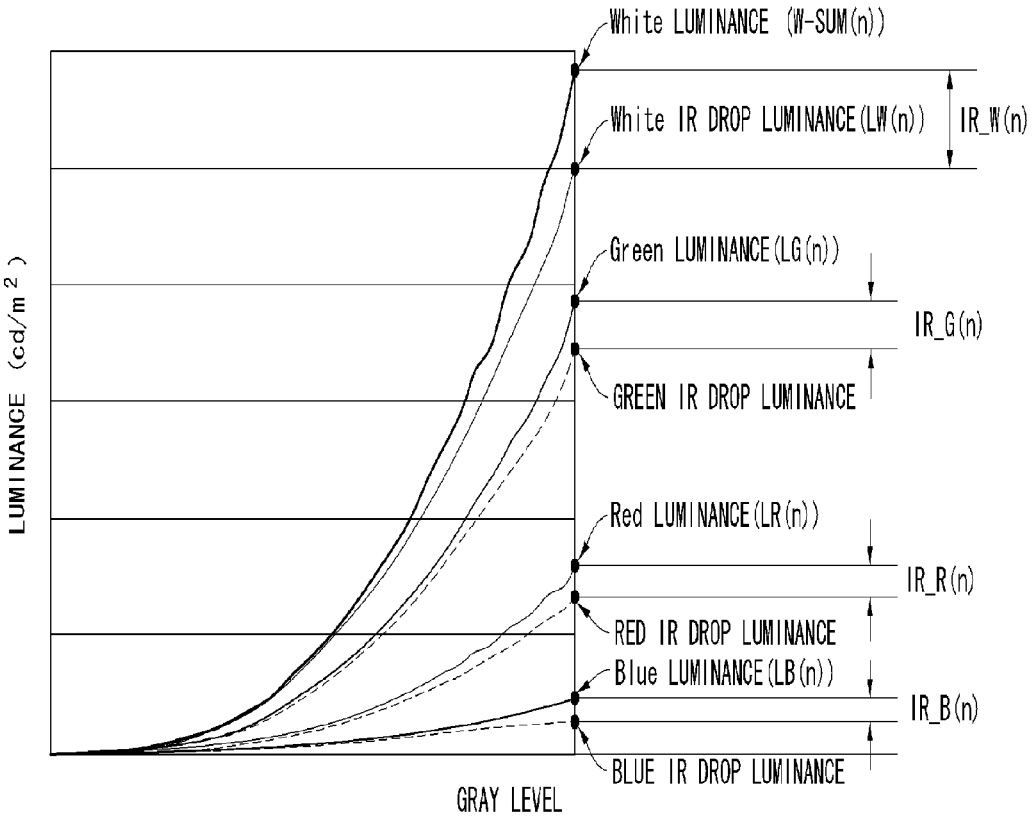
FIG. 19 is a diagram showing IR drop amounts by color and gray scale which occur due to static IR drop, and luminance which is reduced due to static IR drop in W, R, G, and B considered in applying white balance.
Figure 20:
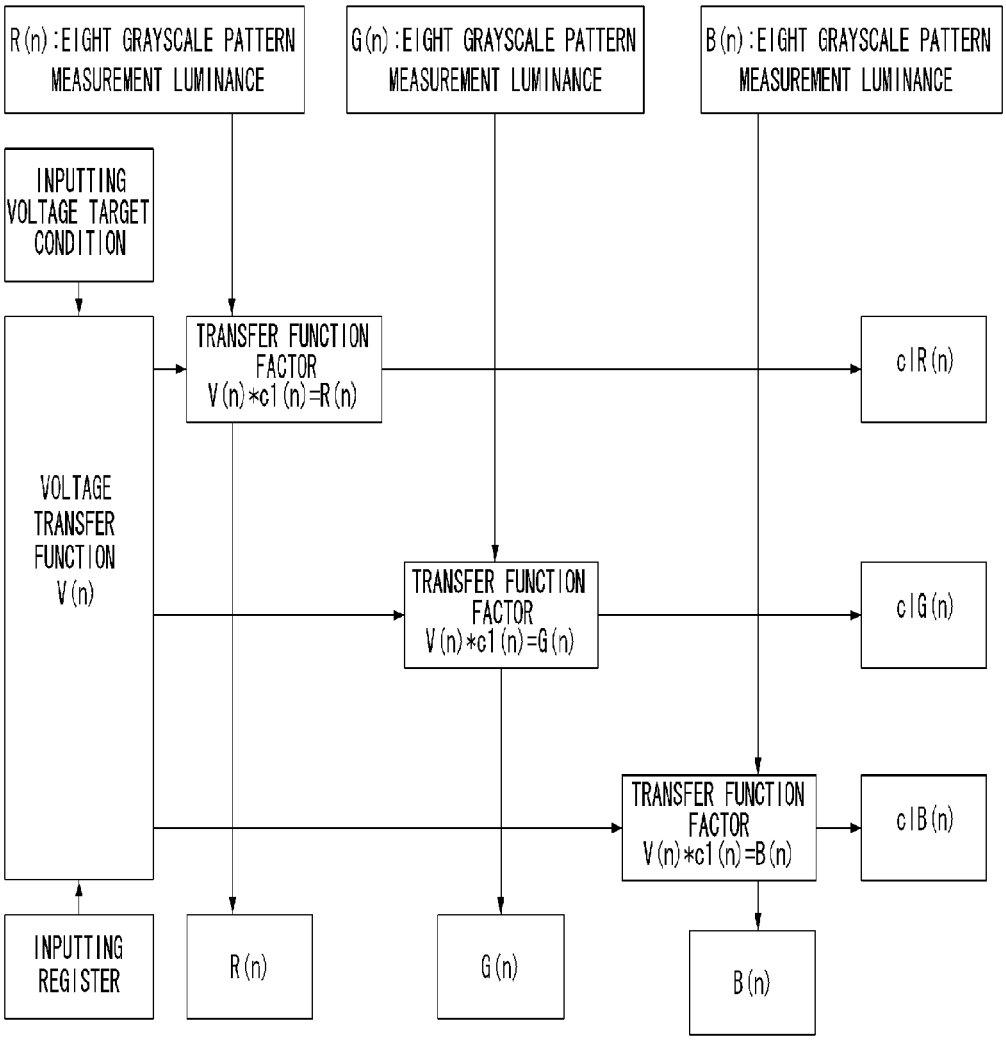
FIG. 20 is a diagram illustrating a method which calculates an IR drop transfer factor for calculating static IR drop rates for each of RGB in static IR drop under a white state.
Figure 21:
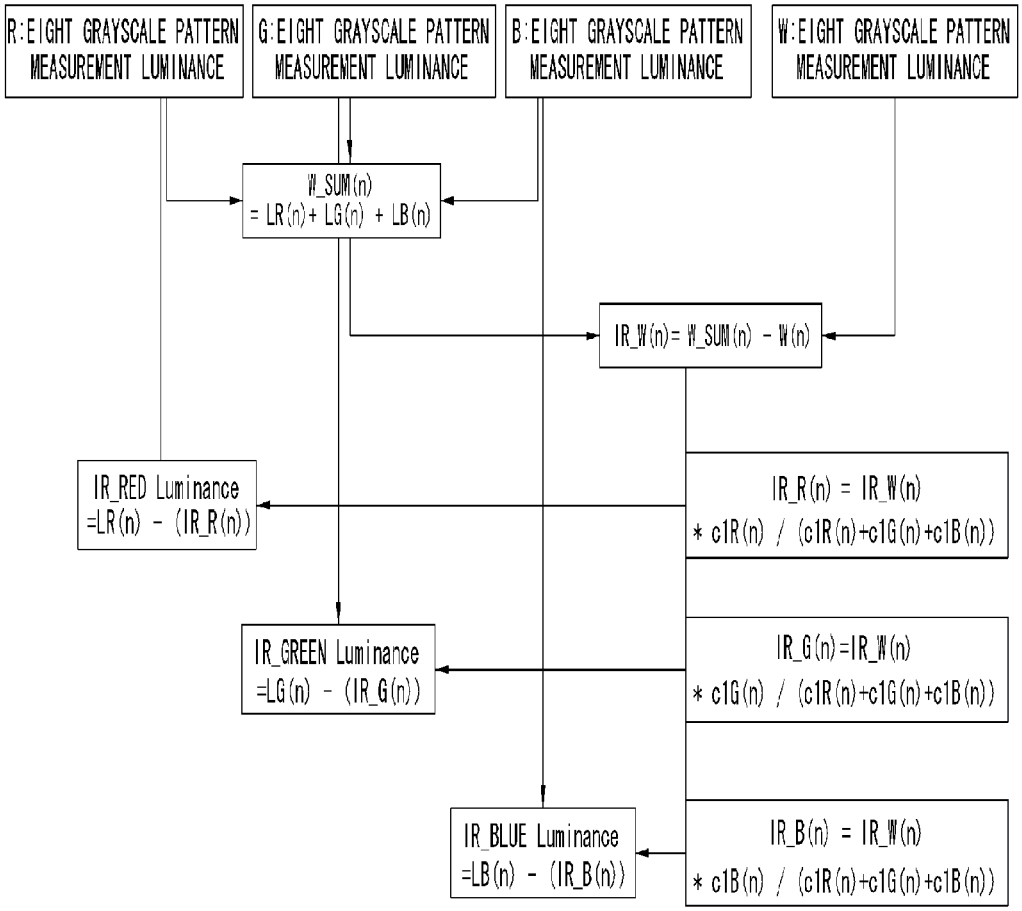
FIG. 21 is a diagram illustrating a method which calculates total static IR drops, which occur in white luminance at a rate based on an IR drop transfer factor, for each of RGB and gray scale.

FIG. 19 shows IR drop amounts by color and gray scale which occur due to static IR drop, and luminance which is reduced due to static IR drop in W, R, G, and B considered in applying white balance. FIG. 20 illustrates a method which calculates an IR drop transfer factor for calculating static IR drop rates for each of RGB in static IR drop having a white state. FIG. 21 illustrates a method which calculates total static IR drops, which occur in white luminance at a rate based on an IR drop transfer factor, for each of RGB and gray scale.

Referring to FIGS. 19 to 21, in an n grayscale level, theoretical white luminance "W_SUM(n)" is defined as the sum of R luminance "LR(n)" in separate driving, G luminance "LG(n)" in separate driving, and B luminance "LB(n)" in separate driving, and actual white luminance "LW(n)" is luminance in separate driving of RGB data and is less than the theoretical white luminance "W_SUM(n)". Accordingly, a white IR drop luminance amount "IR_W(n)" becomes "W_SUM(n)−LW(n)". (The terms "white" and "white color" are used interchangeably throughout this document.)

R luminance "IR_RED(n)" in realizing a white color is a value "LR(n)−(IR_R(n))" that is obtained by subtracting an R value "IR_R(n)", which is contributed to a static IR drop luminance amount in driving of white, from R luminance "LR(n)" in separate driving. By the above-described proportional relationship, the contributed R value "IR_R(n)" for the static IR drop luminance amount may be calculated as "IR_W(n)*{c1R(n)/(c1R(n)+c1G(n)+c1B(n))}".

G luminance "IR_GREEN(n)" in realizing a white color is a value "LG(n)−(IR_G(n))" that is obtained by subtracting a G value "IR_G(n)", which is contributed to the static IR drop luminance amount in driving of white, from G luminance "LG(n)" in separate driving. The contributed R value "IR_G(n)" for the static IR drop luminance amount may be calculated as "IR_W(n)*{c1G(n)/(c1R(n)+c1G(n)+c1B(n))}".

B luminance "IR_BLUE" in realizing a white color is a value "LG(n)−(IR_G(n))" that is obtained by subtracting a B value "IR_B(n)", which is contributed to the static IR drop luminance amount in driving of white, from B luminance "LB(n)" in separate driving. The contributed B value "IR_B(n)" for the static IR drop luminance amount may be calculated as "IR_W(n)*{c1B/(c1R+c1G+c1B)}".

The above description is expressed as Equation (9) below.

$$IR_W(n)=W_SUM(n)-LW(n),$$

$$W_SUM(n)=LR(n)+LG(n)+LB(n),$$

$$IR_RED(n)=LR(n)-IR_R(n),$$

$$IR_GREEN(n)=LG(n)-IR_G(n),$$

$$IR_BLUE(n)=LB(n)-IR_B(n),$$

$$IR_R(n)=IR_W(n)*c1R(n)/(c1R(n)+c1G(n)+c1B(n)),$$

$$IR_G(n)=IR_W(n)*c1G(n)/(c1R(n)+c1G(n)+c1B(n)),$$

$$IR_B(n)=IR_W(n)*c1B(n)/(c1R(n)+c1G(n)+c1B(n)),$$

$$c1R(n)=LR(n)/VR(n),$$

$$c1G(n)=LG(n)/VG(n),$$

$$c1B(n)=LB(n)/VB(n) \quad (9)$$

where n indicates a grayscale level from 0 to 255, IR_W(n) indicates a static IR drop luminance amount of white in an n grayscale level, W_SUM(n) indicates theoretical white luminance in the n grayscale level, LW(n) indicates actual white luminance in the n grayscale level, LR(n) indicates separate R luminance in the n grayscale level, LG(n) indicates separate G luminance in the n grayscale level, LB(n) indicates separate B luminance in the n grayscale level, IR_R(n) indicates an R value that is contributed to the static IR drop luminance amount in the n grayscale level, IR_G(n) indicates a G value that is contributed to the static IR drop luminance amount in the n grayscale level, IR_B(n) indicates a B value that is contributed to the static IR drop luminance amount in the n grayscale level, c1R(n) indicates a static IR drop efficiency proportion factor of R data in the n grayscale level, c1G(n) indicates a static IR drop efficiency proportion factor of G data in the n grayscale level, c1B(n) indicates a static IR drop efficiency proportion factor of B data in the n grayscale level, VR(n) indicates an R driving voltage in the n grayscale level, VG(n) indicates a G driving voltage in the n grayscale level, and VB(n) indicates a B driving voltage in the n grayscale level.

As expressed in Equation (9), in the n grayscale level, the theoretical white luminance "W_SUM(n)" and the actual white luminance "LW(n)" are obtained, a difference between the theoretical white luminance "W_SUM(n)" and the actual white luminance "LW(n)" is calculated, and thus, the maximum static IR drop amount "IR_W(n)" is obtained in the same RGB luminance. When the maximum static IR drop occurs, this is a state where RGB data are included at the same ratio and white data is entirely applied in each grayscale level. For convenience of calculation, "n" may be for only eight grayscale points that are representative inflection points among 256 grayscale levels.

To calculate a degree of contribution of RGB lines to the maximum static IR drop amount "IR_W(n)", in each grayscale level, respective static IR drop efficiency factors c1R, c1G and c1B of RGB data are calculated, and among the maximum static IR drop amount "IR_W(n)", "c1R/(c1R+c1G+c1B)", "c1G/(c1R+c1G+c1B)", and "c1B/(c1R+c1G+c1B)," which are a plurality of contributed RGB data values, are obtained.

The transfer function processing unit 406 of FIG. 10 may calculate the voltage-luminance static IR drop efficiency proportion factors "c1R(n)", "c1G(n)" and "c1B(n)" with only eight RGB grayscale points using the method of FIG. 20. The static IR drop efficiency proportion factor of Equation (9) is a value that is obtained by dividing the luminance value "A+B" of Equation (5) by the gamma voltage "a" and has been simplified. In an initial state, the source voltages V and V1 are fixed and thus may be treated as constants.

By performing the operation of FIG. 21 with the static IR drop efficiency proportion factor that is obtained by the method of FIG. 20, a gamma register value for static IR drop calibration is calculated in each grayscale level. The register value is used to adjust a gamma grayscale voltage.

Figure 22:
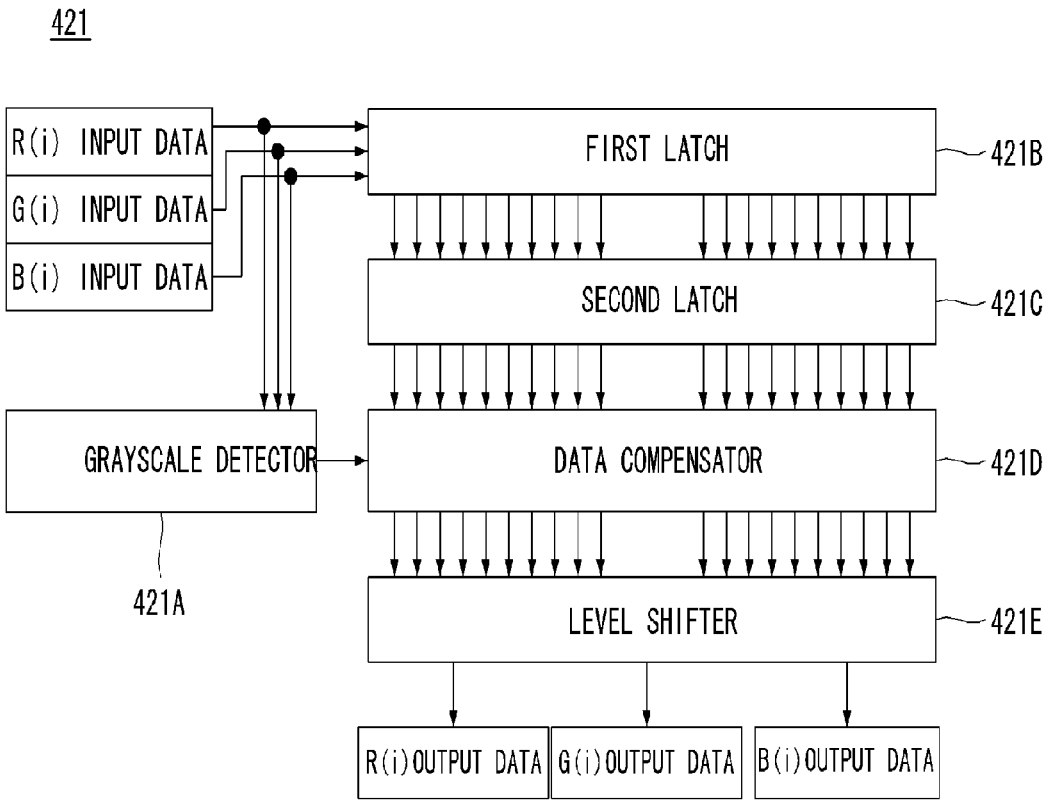
FIG. 22 is a diagram illustrating a detailed configuration of an IR drop compensation unit of FIG. 10 for calibrating dynamic IR drop due to an amount of changed data.

FIG. 22 illustrates a detailed configuration of the IR drop compensation unit 421 of FIG. 10 for calibrating dynamic IR drop due to an amount of changed data.

Referring to FIG. 22, the IR drop compensation unit 421 analyzes grayscale values of input digital image data by a horizontal line or a vertical line, and determines whether a high grayscale characteristic pattern is in a low grayscale wallpaper where an input image causes dynamic IR drop. Furthermore, when the input image causes dynamic IR drop, the IR drop compensation unit 421 compensates for input data in proportion to dynamic IR drop, and outputs the compensated data. When the input image does not cause dynamic IR drop, the IR drop compensation unit 421 bypasses the input data.

For this end, the IR drop compensation unit 421 includes a grayscale detector 421A, a first latch 421B, a second latch 421C, a data compensator 421D, and a level shifter 421E.

The grayscale detector 421A converts 8-bit binary digital image data Ri, Gi and Bi, inputted to respective sub-pixels, into decimal image data to display the image data at a corresponding grayscale level among 256 grayscale levels, and thus calculates respective grayscale values of all data for a horizontal line or vertical line. The grayscale detector 421A analyzes a grayscale level that causes crosstalk, based on luminance differences between grayscale levels and the number of occupied grayscale levels of data in each horizontal line or vertical line, and calculates a dynamic IR drop amount due to an amount of data having a grayscale level that causes crosstalk. The grayscale detection unit 421A may receive an indication of whether to detect a grayscale level of a horizontal line or vertical line, and a reference level for calculating of the dynamic IR drop amount from the transfer function processing unit 406 of FIG. 10.

The first latch 421B samples digital image data Ri, Gi and Bi that are inputted to respective sub-pixels, latches the data by one horizontal line, and simultaneously outputs all data of one horizontal line.

The second latch 421C latches data (inputted from the first latch 421B) of one horizontal line at one-horizontal line intervals, and outputs the latched data.

The data compensator 421D generates a voltage, due to a luminance difference to be actually compensated, as binary compensation data on the basis of detection information inputted from the grayscale detector 421A, namely, a grayscale level causing crosstalk and a dynamic IR drop amount due to an amount of data having the grayscale level. The compensation data may be added to all data corresponding to each horizontal line or vertical line, or selectively added only to specific low luminance data that causes significant crosstalk.

The level shifter 421E level-shifts digital image data that are compensated for dynamic IR drop and are inputted from the data compensator 421D, and supplies the level-shifted image data to the decoder selectors 422R, 422G and 422B of FIG. 10, respectively. The level shift is for converting the levels of the image data into voltage levels suitable for the operations of the decoder selectors 422R, 422G and 422B.

To apply dynamic IR drops for each horizontal line, when each input data is converted into grayscale data in real time, analysis is completed for each line, and a compensation value is determined, the IR drop compensation unit 421 applies the compensation value for entire one line to data of one horizontal line after the second latch 421C has performed latch. However, since a data analysis period of one frame is taken for applying dynamic IR drops by vertical line, the IR drop compensation unit 421 may further include a frame memory, and analyze data of a current vertical line and then apply the analyzed result to a next frame. Also, a frame memory is not used for vertical line compensation, although a current frame is analyzed and the analyzed result is applied to a next frame, since a screen is not changed to a new screen by frame unit, use is not limited.

In this way, the IR drop compensation unit 421 converts grayscale levels of respective input binary data of sub-pixels into decimal grayscale levels, analyzes the data, detects data having a grayscale level that causes crosstalk, determines a degree of compensation, adds a grayscale compensation value suitable for the degree of compensation to the input data, and thus compensates for dynamic IR drop in real time. The IR drop compensation unit 421, as illustrated in FIG. 10, may be built in the data driving IC 42 and perform an operation thereof. For example, if the adjustment of a gamma grayscale level due to static IR drop has been completed, the operation of the IR drop compensation unit 421 may be processed by the control center 10. The IR drop compensation unit 421 may determine a grayscale level on the basis of binary grayscale information itself without converting a grayscale level of binary data into a decimal grayscale level, in logic circuit configuration.

Figure 23:
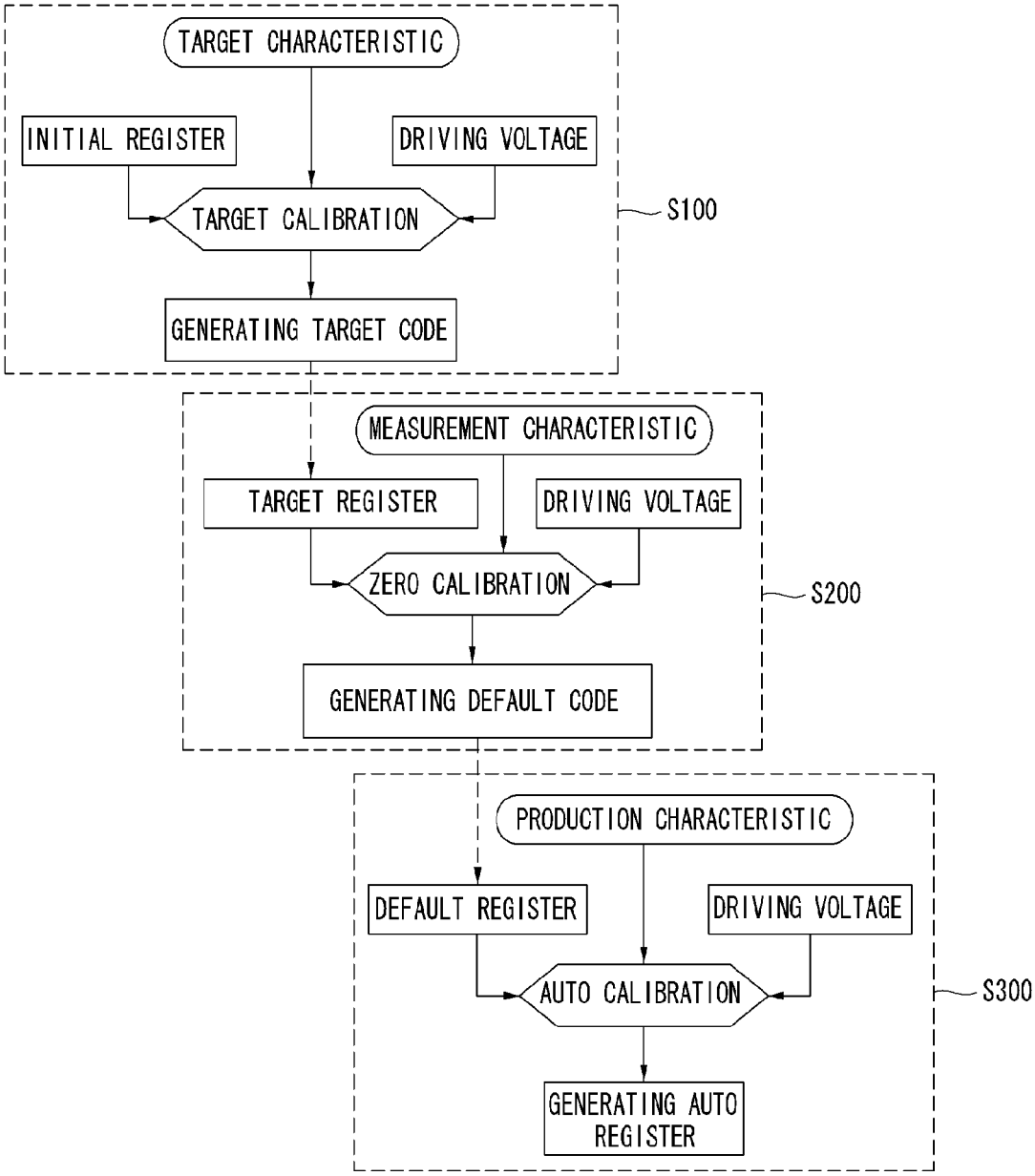
FIGS. 23 to 25 are diagrams schematically illustrating a calibration method using the adjustment of factor values of transfer functions, according to an embodiment of the present invention.
Figure 24:
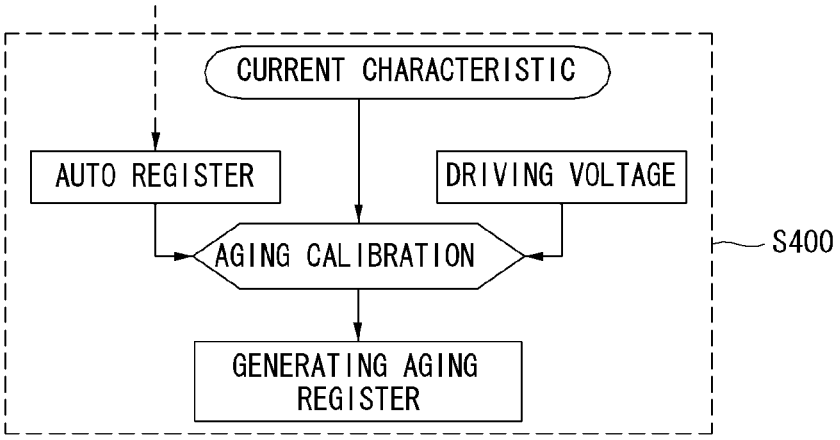
Figure 25:
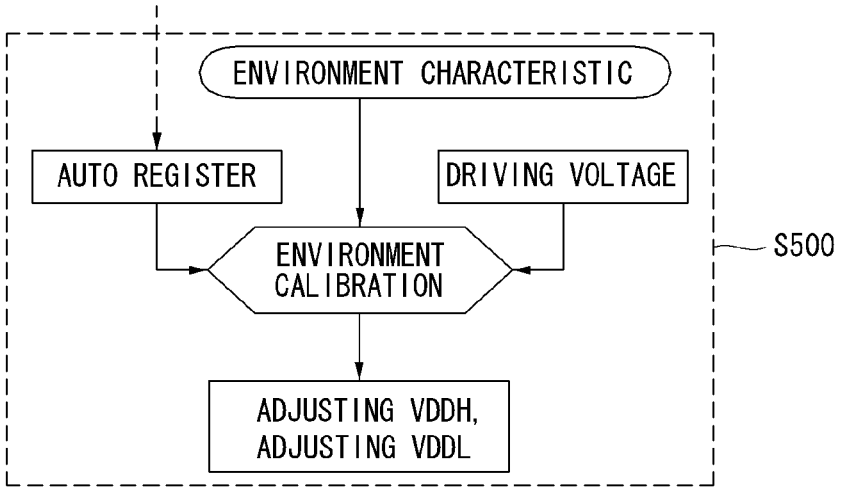

3. Detailed Calibration Method Using Adjustment of Factor Value of Transfer Function FIGS. 23 to 25 schematically illustrate a calibration method using the adjustment of factor values of transfer functions, according to an embodiment of the present invention.

The calibration method according to an embodiment of the present invention includes calibration that is performed before the completion of a product, and calibration that is performed after the manufacture of the complete product.

The calibration, performed before the completion of the product, includes a target calibration stage S100 that generates the target code as illustrated in FIG. 19, a zero calibration stage S200 that generates a default code, and an auto calibration stage S300 that updates RGB gamma registers with an auto register.

The calibration, performed after the manufacture of the complete product, includes an aging calibration stage S400 that updates the RGB gamma registers with an aging register as illustrated in FIG. 20, and an environment calibration stage S500 that adjusts the high-level gamma source voltage VDDH and the low-level gamma source voltage VDDL as illustrated in FIG. 21.

Target calibration is an operation that sets a target luminance value which becomes a reference of calibration by using an initial register, and establishes a correlation between the target luminance value and a transfer function, based on an arbitrary target voltage condition (condition that has been decided in a development stage). The target calibration operation calculates a target register for each of grayscale levels of eight points for each of RGB, by using target calibration transfer factors that are calculated based on the target luminance value and the arbitrary target voltage condition.

The target register is calculated based on an initial register setting value, an arbitrary target voltage condition, target white luminance, target white color coordinates, and color coordinates R(x,y), G(x,y) and B(x,y) being inherent characteristic of a light emitting organic material that have been decided in the development stage. The voltage transfer function and the luminance transfer function have a correlation therebetween with the target register. The target register is used as a reference register for calculating a plurality of zero calibration transfer factors suitable for an actual environment in a subsequent zero calibration stage. Considering a calibration margin, the arbitrary voltage target condition may be set as a condition close to zero calibration when possible in the development stage.

In setting a target condition for target calibration, it is required to calculate white as target RGB luminance values by performing white balance calibration. Herein, the target condition includes a target voltage condition and a target luminance condition.

The target voltage condition is decided in developing stage, and includes gamma source voltages VDDH and VDDL, cell driving voltages PVDD and PVEE, initial gamma register value, and RGB material coordinate values of the data driving IC 42.

The target luminance condition is determined according to a product specification, and includes target high white luminance and white color coordinates.

In the target calibration stage, since theoretical data are used instead of actual measurement data, IR drop does not occur, and thus, IR drop is not considered for calibration. The target calibration is mainly used when the specification of a new product is decided and the production of the new product is started, or when characteristic related to target luminance or a source voltage is changed. That is, the target calibration is performed when the purpose of a product or a gamma source voltage and/or cell driving voltage of a data driving IC is changed.

Zero calibration is an operation that applies a target register, obtained as a result of target calibration, to an actual product to calculate zero calibration transfer factors as measurement luminance values, and then calculates a compensation voltage with the zero calibration transfer factors and the target luminance value. That is, the zero calibration is a stage that matches an actual manufacture environment and the target luminance value through adjustment. In other words, the zero calibration is a stage that calculates the zero calibration transfer factors with actual measurement luminance that is obtained with the same voltage condition and register as those of the target calibration operation, and applies the target luminance value and zero calibration transfer factors to the luminance transfer function to calculate a compensation voltage equal to a difference between the target calibration transfer factors and the zero calibration transfer factors.

The actual measurement luminance is compensated for with the target luminance through zero calibration. Zero calibration is generally performed after target calibration has been performed, but when characteristic related to target luminance or a source voltage is not changed or only material characteristic and the structure of a pixel are changed, zero calibration may be performed separately. Even in products having the same specification, when manufacture characteristic is significantly changed in producing, by performing a readjustment operation through zero calibration, a time taken in subsequent auto calibration is shortened, and the accuracy of auto calibration increases. As a result of zero calibration, a default register that is obtained for grayscale levels of eight points for each of RGB is stored in a driving board and used as a reference register in a production line having the same material characteristic or structure characteristic.

Auto calibration is a stage that is performed after zero calibration, for additionally calibrating a manufacturing process deviation. Auto calibration is required to be performed within the shortest time because it is applied during a mass-production stage. Auto calibration is performed simultaneously with zero calibration. Since a difference between transfer factors is relatively small in the mass production stage, auto calibration is performed only for an important part where the transfer factors are to be changed, thus shortening a calibration time. Parts that require calibration are three points that include maximum luminance, slope luminance (one point having a large inflection point among intermediate grayscale luminance), and critical point luminance. When data are secured for respective grayscale levels of three points for each of RGB, a luminance value or a voltage value may be calculated with a transfer function. However, since a process is relatively stable in the mass production stage, a difference between RGB slope luminance is not large. Accordingly, slope luminance can be simplified to any one of RGB data.

Moreover, by setting the level of critical luminance to higher than a lowest point, the auto calibration operation may perform calibration based on effective use luminance even without considering the influence of a deviation between products due to critical point non-uniformity that is a limitation of the LTPS backplane. The auto calibration operation sets a part, which is higher than an actual critical point and has stable light luminance in setting a critical point, as a critical point, namely, a slope point. Furthermore, the auto calibration operation arithmetically calculates an unstable luminance deviation less than a set critical point and a non-uniform part of a critical point of the LTPS backplane with the luminance transfer function, and applies the calculated result to a transfer function algorithm. Therefore, since a stable target luminance value obtained from an entire luminance characteristic curve is applied to near a critical point without depending on an unstable luminance characteristic curve near to the critical point, the voltage transfer function can always provide a driving voltage condition based on entire stable characteristic. Referring to FIG. 6, in a low luminance period below effective use luminance, it can be seen that critical luminance "B" has been calculated as lowest luminance based on a luminance ratio between RGB data that have been obtained in a white balance calibration stage.

Aging calibration is a stage that calibrates entire luminance being reduced due to the decrease in efficiency of RGB materials with the elapse of operation time or color being changed due to the deviation of white balance, to an initial state. The deviation of white balance is because a degree of deterioration of RGB varies when a resistance value for each RGB increases and light emission luminance decreases with the elapse of a use time. Aging calibration is an operation that is separately applied to each product after a complete product is manufactured. The aging calibration operation calibrates a difference between transfer factors that are changed by service life based on a pre-stored result register (auto register) of auto calibration, with a voltage. The aging calibration operation calculates a relative amount of current decreased due to the reduction in service life, on the basis of a reference current (luminance-current ratio value) that has been secured in performing zero calibration, converts the calculated result into a luminance ratio, and then changes register resistance values for cell driving voltages for each of RGB on the basis of the luminance ratio. Since a difference in current has a proportional relationship with a luminance difference, if the difference in current is converted into the luminance difference, calibration may be performed by measuring a current even without using a luminance measurement apparatus. For this end, the current amount reference value is required to be stored in the zero calibration stage. Aging calibration may be applied identically even when recalibration is performed after repairing the OLED device. Aging calibration is a method where a user may readjust the deviation of white balance due to an aging difference between RGB, at an arbitrary time.

Environment calibration is an operation that calibrates a normal driving condition that is changed due to the change of an ambient environment and a light leakage current. The environment calibration operation senses an ambient environment condition and identically matches a changed driving condition to a normal driving condition at a predetermined initial time. Environment calibration is categorized into temperature calibration and light leakage current calibration.

Environment calibration is performed for causing constant luminance not to be changed by the change of transfer factors due to an operation temperature and an ambient temperature. The change of a temperature causes the change of efficiency. The change of efficiency causes the change of a resistance. The change of the resistance causes the change of a driving current. The change of the driving current causes the change of luminance. Therefore, the temperature change and the luminance change have a proportional relationship in transfer function. The temperature calibration operation increases/decreases the input level of the low-level gamma source voltage VDDL according to a temperature, and thus prevents transfer factors from being changed. The temperature calibration operation prevents the decrease in service life and the increase in an amount of luminance that is caused by the continuous increase in transfer factors due to the rising of a temperature, or prevents luminance from being reduced by a difference between the transfer factors due to the decrease in an ambient temperature. The temperature calibration operation adjusts the low-level source voltage VDDL, and thus can prevent the service life of an organic layer material from being rapidly reduced by the activation of an operation due to the rising of a temperature and prevent the increase in a driving current due to the increase in a temperature, thereby maintaining an amount of a driving current as an initial value.

Light leakage current calibration is used to cure the problem that the operation at a low grayscale luminance point is not performed due to the increase in an off current. The off current is generated by a light leakage current that is generated from a driving TFT of the backplane by the influence of ambient light. It is difficult to realize an accurate low gray scale due to a light leakage current in performing an operation near to a critical point. In this case, by changing a voltage (i.e., high-level gamma source voltage VDDH) near the critical point of the operation current in proportion to an amount of generated light leakage current, an accurate low gray scale can be realized.

The calibration method of the present invention further includes white balance calibration and IR drop calibration.

White balance calibration is specifically performed in the target calibration operation, and matches RGB target luminance with actual measurement luminance in the zero calibration operation, auto calibration operation, and aging calibration operation, thus maintaining white balance in a calibration state. Information processed in a transfer function is relevant only to three colors of RGB, but the combination of RGB is used as one color in an actual product. In this operation, the combined result of colors varies according to a ratio of the three colors, and particularly, a color combination difference appears clearly, whereby white balance is necessarily considered in applying a transfer function for three-color calibration.

White balance calibration includes: a stage that calculates target value white luminance, target value white color coordinates, and RGB luminance enabling the maintenance of white balance through the white balance operation and the IR drop calibration operation; and a stage that calibrates the RGB luminance by applying static IR drop. The RGB luminance obtained in the white balance operation is target luminance to be used in target calibration, and this relationship between the RGB luminance and the target luminance is maintained even in calibration after target calibration. IR drop considered in white balance calibration is static IR drop, and is obtained for total grayscale levels having a white state that cause the maximum IR drop state, then being reflected in white balance calibration. A method of calculating RGB luminance from white luminance uses a correlation between luminance and color coordinates based on a color coordinate conversion formula that has been known to those skilled in the art.

The white balance operation indicates an operation that determines white luminance and color coordinate values (chromaticity) "x and y" based on a relationship between white luminance and color coordinate values through formula conversion between 1931CIE-RGB system and 1931CIE-XYZ system according to CIE931 standard chromaticity system, and calculates RGB luminance with the color coordinate conversion formula.

Herein, white color coordinates (x, y) are defined in target luminance, but color coordinates (x, y) in RGB luminance require the input of an actual value of an organic material. This is because the white color coordinates are determined by an RGB luminance ratio based on color coordinates of an actual material, for calculating accurate RGB luminance. In a subsequent calibration stage, when matching target luminance with actual measurement luminance by using the calculated RGB luminance as target luminance, white balance based on an actual measurement material is adjusted in white luminance.

In sum, white balance calibration denotes an operation that calculates RGB luminance with the color coordinate conversion formula, and an operation that calculates RGB luminance where white balance is maintained by static IR drop calibration.

IR drop calibration may be performed together in performing zero calibration, auto calibration, and aging calibration. Zero calibration, auto calibration, and aging calibration are performed for each of RGB data, but the RGB data are simultaneously driven in an actual image, thereby realizing color at a corresponding ratio. An IR drop amount is greater when the RGB data are simultaneously driven than when the RGB data are separately driven.

Therefore, in zero calibration, auto calibration, and aging calibration, if IR drop calibration is not performed, an unintended result may be obtained. Accordingly, in performing zero calibration, auto calibration, and aging calibration, it should be considered that a cell driving voltage decreases by the change of a driving resistance for each of the RGB data when the RGB data are simultaneously driven, and luminance is reduced by the decrease.

IR drop is categorized into static IR drop due to a line resistor, and dynamic IR drop due to an amount of changed data.

Static IR drop is measured in a white data state indicating the maximum drop amount, and reflected in performing gamma calibration (see FIGS. 18 to 21).

Dynamic IR drop is calculated on the basis of an analyzed result for a difference in changed amount of input data, and reflected in real-time compensation of input data (see FIG. 22).

The present invention performs static IR drop calibration and dynamic IR drop calibration together, and thus, the same data are reduced by the change of data in a specific low luminance grayscale level, thereby decreasing crosstalk that appears as a striped pattern having a belt shape.

The principle of static IR drop calibration applies test patterns for each of RGB grayscale levels, measures entire grayscale luminance for RGB, and then calculates IR drop efficiency proportion factors for each of RGB. In the same scheme, by applying test patterns for total grayscale levels to a white (W) pattern, W luminance of total grayscale levels is measured. By summing all measured luminance for each of RGB, W luminance in a state with no IR drop can be arithmetically obtained. By subtracting W luminance (where IR drop obtained from an actual W pattern is at its maximum) from the W luminance in a state with no IR drop, a static IR drop amount for each grayscale level in W luminance can be calculated. A static IR drop amount obtained in W drop at each grayscale level is divided according to a degree of contribution by RGB, in which case the IR drop efficiency proportion factor obtained in the IR drop calibration stage is used. To a description on an efficiency proportion factor condition in this operation, in an operation of obtaining actual RGBW measurement luminance, a driving voltage applied in RGB is the same as a driving voltage applied in W, and a test pattern applied in RGB is the same as a test pattern applied in W.

Therefore, an IR drop efficiency proportion factor, obtained between a driving voltage and measurement luminance in each of RGB colors, is applied at the same ratio as an IR drop efficiency proportion factor applied to RGB data in driving W data. Also, an IR drop amount between RGB data and W data is applied at the same ratio. In performing static IR drop calibration, the total grayscale levels may be replaced by a plurality of grayscale levels (for example, eight grayscale levels changeable by a gamma resistors) less than the total number of grayscale levels when being actually applied to the data driving IC 42. Static IR drop is easily calculated by a numerical formula and logic, and reflected in a gamma voltage register in performing gamma calibration.

In dynamic IR drop, the change of a resistance value causing the dynamic IR drop is more sensitive to the change of data amount than a data amount difference, and thus, it is required to perform dynamic IR drop calibration by analyzing an amount of changed data that are inputted in real time.

Since static IR drop calibration is based on a state where RGB data having the same grayscale level cause maximum IR drop, dynamic IR drop calibration analyzes an amount of changed data that are inputted in real time, and additionally compensates for input data, where maximum static IR drop compensation has been performed, by horizontal line. For this end, dynamic IR drop calibration analyzes an amount of changed data that are inputted in real time, and thus finds a crosstalk pattern based on an input grayscale distribution of total data for each horizontal line. The crosstalk pattern denotes a pattern where a difference between an upper grayscale level and a lower grayscale level is large, and thus, some minor upper grayscale levels exist over the major bottom grayscale levels.

Dynamic IR drop calibration analyzes a grayscale difference and the size of an upper grayscale pattern to determine a compensation value. Depending on the case, dynamic IR drop for a vertical line may be compensated for by the same scheme as that of dynamic IR drop for a horizontal line.

When static IR drop calibration and dynamic IR drop calibration may have a value within a visual discernment error, a case where IR drop in a low grayscale level and a difference between data change amounts are small may not be considered for the purpose of simplifying the logic, and moreover, a vertical crosstalk may be ignored when not being sensitive particularly.

Hereinafter, the above-described methods will be described in detail.

Figure 26:
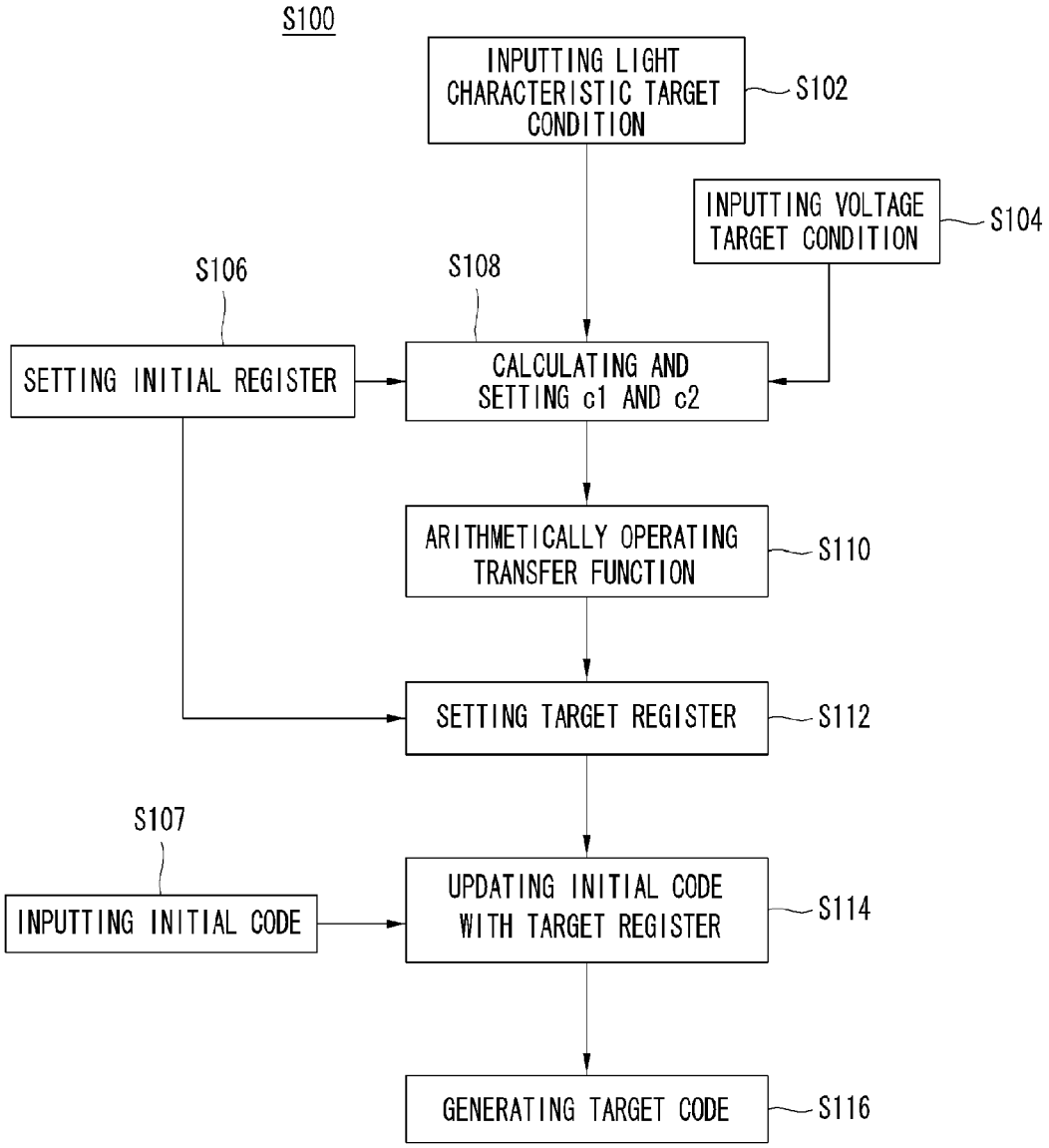
FIG. 26 is a diagram illustrating in detail a target calibration stage.

FIG. 26 illustrates in detail the target calibration stage S100.

Referring to FIG. 26, the target calibration stage S100 sets a light characteristic target condition (target luminance value) and a voltage target condition (an arbitrary voltage value decided in a development stage) for eight point grayscale levels (total 24 grayscale levels) of each of RGB data to be displayed on an OLED display device, and an initial register of an initial code that has been secured in the development stage in stages S102, S104, S106 and S107.

The target calibration stage S100 applies an arbitrary voltage value and a target luminance value to a transfer function to calculate and set target calibration transfer factors "c1 and c2", on the basis of the initial register of the initial code. The target calibration stage S100 matches (r=1/r) the slope factor "r" of the voltage transfer function with the slope factor "1/r" of the luminance transfer function through a transfer function arithmetic operation using the target calibration transfer factors "c1 and c2" in stages S108, S110 and S112. The voltage transfer function and the luminance transfer function are correlated to each other by the matching adjustment (r=1/r) of the slope factors, and thus a target register is calculated as the correlated result. The target register is a gamma register value that has been calibrated for updating the initial register, and calculated for each of RGB gamma registers.

The target calibration stage S100 updates the initial register of the initial code with a target register to generate a target code in stages S114 and S116. The target code may be stored in a driving board so as to be downloaded in performing zero calibration.

Figure 27:
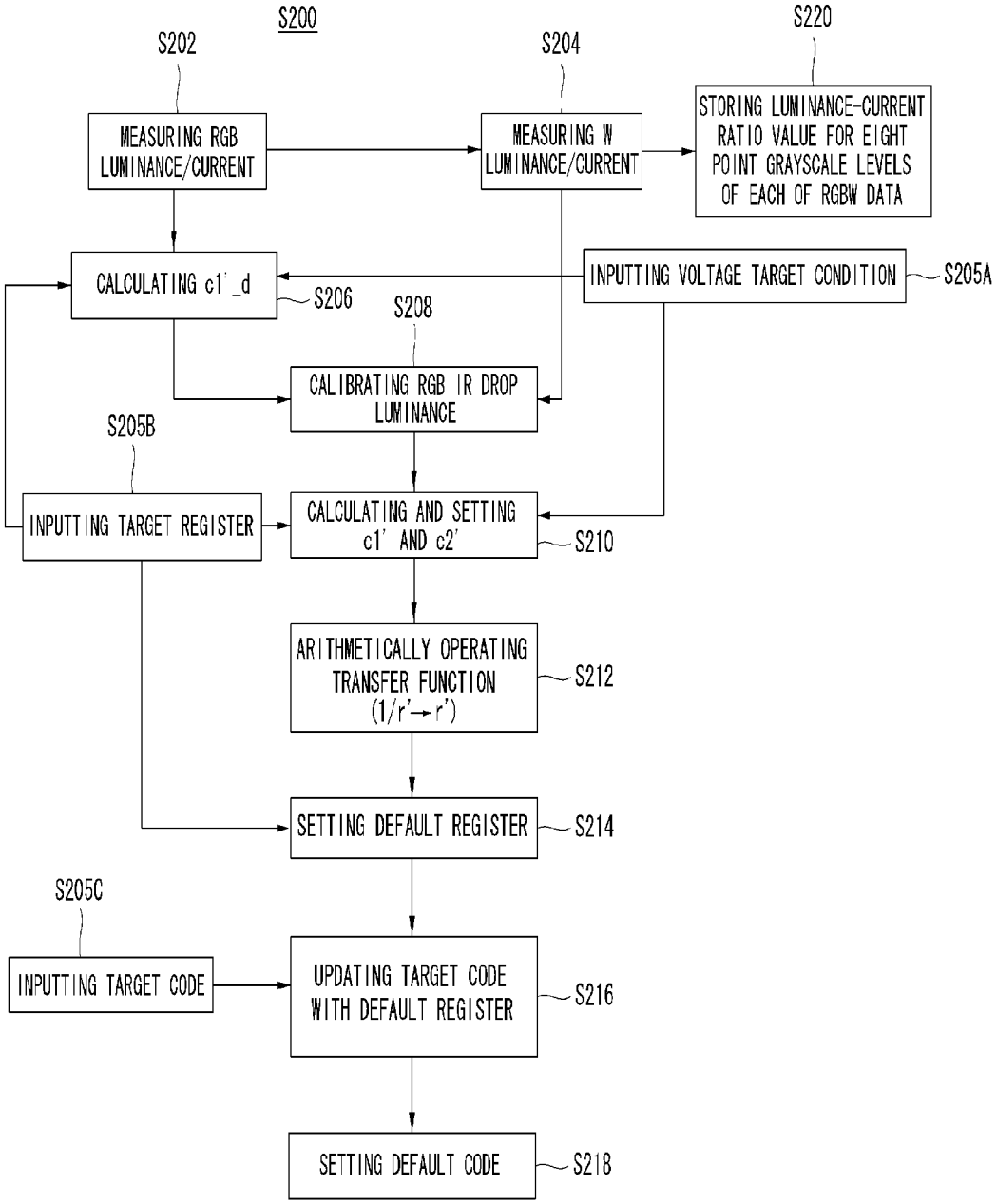
FIG. 27 is a diagram illustrating in detail a zero calibration stage.

FIG. 27 illustrates in detail the zero calibration stage S200.

Referring to FIG. 27, the zero calibration stage S200 downloads the target code, separately displays RGB test patterns by color on the OLED display device based on the target code, and then measures luminance and a current for each of the RGB test patterns in stage S202. Each of the RGB test patterns includes eight point grayscale levels (total 24 grayscale levels) of each of RGB data.

The zero calibration stage S200 measures luminance and a current for eight point grayscale levels of W data when the RGB test patterns are being simultaneously displayed on the OLED display device in stage S204.

The zero calibration stage S200 applies RGB measurement luminance values to a transfer function, based on the voltage target condition (identical to that of the target calibration stage) and the target register of the target calibration stage S100, and thus calculates a primary zero calibration transfer factor "c1'_d" due to IR drop for each of RGB data in stages S205A and S206. Herein, an amount of changed luminance due to static IR drop is reflected in the primary zero calibration transfer factor "c1'_d" for each grayscale level.

The zero calibration stage S200 applies a W measurement luminance value and the primary zero calibration transfer factor "c1'_d" to the transfer function to calibrate the luminance change of RGB data due to IR drop in stage S208.

The zero calibration stage S200 applies the input voltage target condition, the target register stored in the target calibration stage S100, and a luminance value (for which static IR drop has been calibrated) to the transfer function to calculate and set secondary zero calibration transfer factors "c1' and c2'" by RGB in stage S210.

The zero calibration stage S200 calculates a slope factor "r'" of the voltage transfer function from the luminance value for which static IR drop has been calibrated and a slope factor "1/r'" obtained from the luminance value, calculates a voltage difference by obtaining a voltage transfer function for a target luminance transfer function by using the secondary zero calibration transfer factors "c1' and c2'", and sets a default register corresponding to the calculated voltage difference in stages S212 and S214. The default register is used to update a gamma register value of the target register, and set for each of RGB data.

The zero calibration stage S200 updates the target register of the target code, generated in the target calibration stage S100, with the default register in stages S216 and S218. The default code may be stored in the driving board so as to be downloaded in performing auto calibration.

The zero calibration stage S200 calculates a luminance-current ratio value for eight point grayscale levels (total 32 grayscale levels) of each of RGBW data so as to be used for subsequent aging calibration, and stores the luminance-current ratio value in the MTP memory (see 410 of FIG. 10) of the data driving IC 42 in stage S220.

The zero calibration stage S200 is an operation that generates a default code which is a reference of an auto calibration stage and is to be used in a producing process, and thus requires a collection and a degree of precision for many samples.

Figure 28:
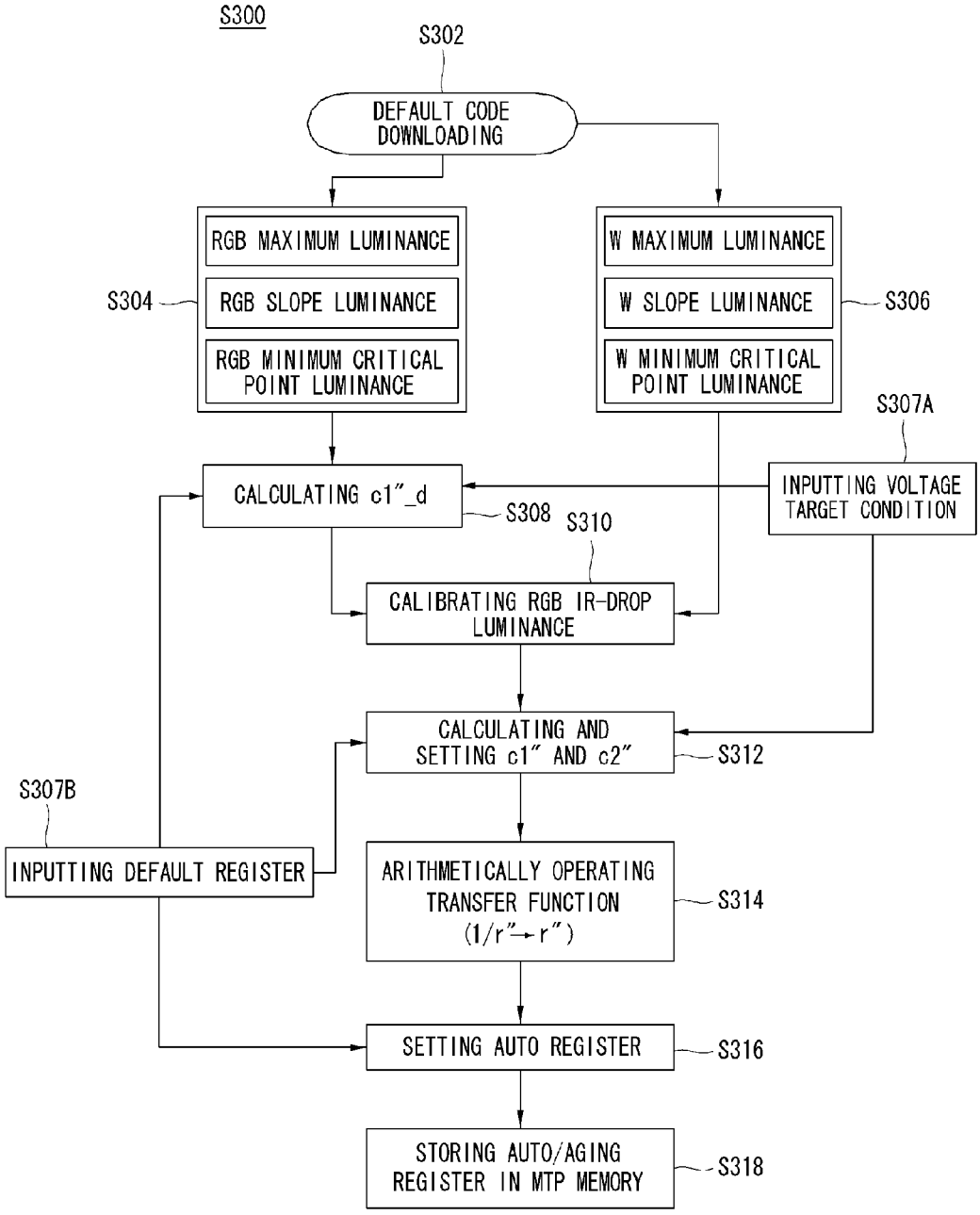
FIG. 28 is a diagram illustrating in detail an auto calibration stage.

FIG. 28 illustrates in detail the auto calibration stage S300.

Referring to FIG. 28, the auto calibration stage S300 downloads the default code that has been set in the zero calibration stage S200, and separately displays the RGB test patterns on the OLED display device, based on the default code in stage S302. Each of the RGB test patterns includes three point grayscale levels (total nine grayscale levels) of each of RGB data.

The auto calibration stage S300 measures luminance for the three point grayscale levels, namely, a grayscale level corresponding to maximum luminance, a grayscale level corresponding to slope luminance (one point having a large inflection point among intermediate grayscale luminance), and a grayscale level corresponding to critical point luminance in stage S304.

The auto calibration stage S300 also measures luminance for three point grayscale levels of W data (i.e., a grayscale level corresponding to maximum luminance, a grayscale level corresponding to slope luminance, and a grayscale level corresponding to critical point luminance), when the RGB test patterns are being simultaneously displayed on the OLED display device in stage S306.

The auto calibration stage S300 applies RGB measurement luminance values to the transfer function to calculate a primary auto calibration transfer factor "c1"_d" due to static IR drop, on the basis of the voltage target condition (identical to that of the target calibration stage) and the default register of the zero calibration stage S200 in stages S307A and S308. Herein, an amount of changed luminance due to static IR drop is reflected in the primary auto calibration transfer factor "c1"_d".

The auto calibration stage S300 applies the W measurement luminance value and the primary auto calibration transfer factor "c1"_d" to the transfer function to calibrate the luminance change of RGB data due to IR drop in stage S310.

The auto calibration stage S300 calculates secondary auto calibration transfer factors "c1" and c2" from the input voltage target condition, the default register stored in the zero calibration stage S200, and a luminance value for which static IR drop has been calibrated in stage S312, and calculates a slope factor "r"" of the voltage transfer function from a slope factor "1/r"" obtained from the luminance value in stage S314.

The auto calibration stage S300 calculates a voltage transfer function for the target luminance transfer function with the secondary auto calibration transfer factors "c1", c2" and r"", calculates a voltage difference for calibrating with the voltage transfer function, and sets an auto register corresponding to the calculated voltage difference in stages S314 and S316. The auto register is used to update a gamma register value of the default register, and set for each of RGB data.

The auto calibration stage S300 stores the auto register in the auto/aging register MTP memory of the data driving IC 42 in stage S318.

As a stage used in a mass production process, the auto calibration stage S300 is performed under a relatively stable condition, and thus requires quick processing. Therefore, optionally, the auto calibration stage S300 may measure total six points that include maximum luminance (four points) of respective RGBW data, slope luminance (one point) of any one of the RGBW data, and critical luminance (one point) of W data without measuring total 12 points by three points for each of the RGBW data unlike the above description, and obtain other luminance data with the luminance transfer function. Accordingly, the present invention minimizes the influence of the non-uniformity of the critical point of the LTPS backplane and the influence of the non-uniformity of a luminance amount in a low luminance period, and thus can increase the accuracy of calibration and reduce the manufacture tack time.

Figure 29:
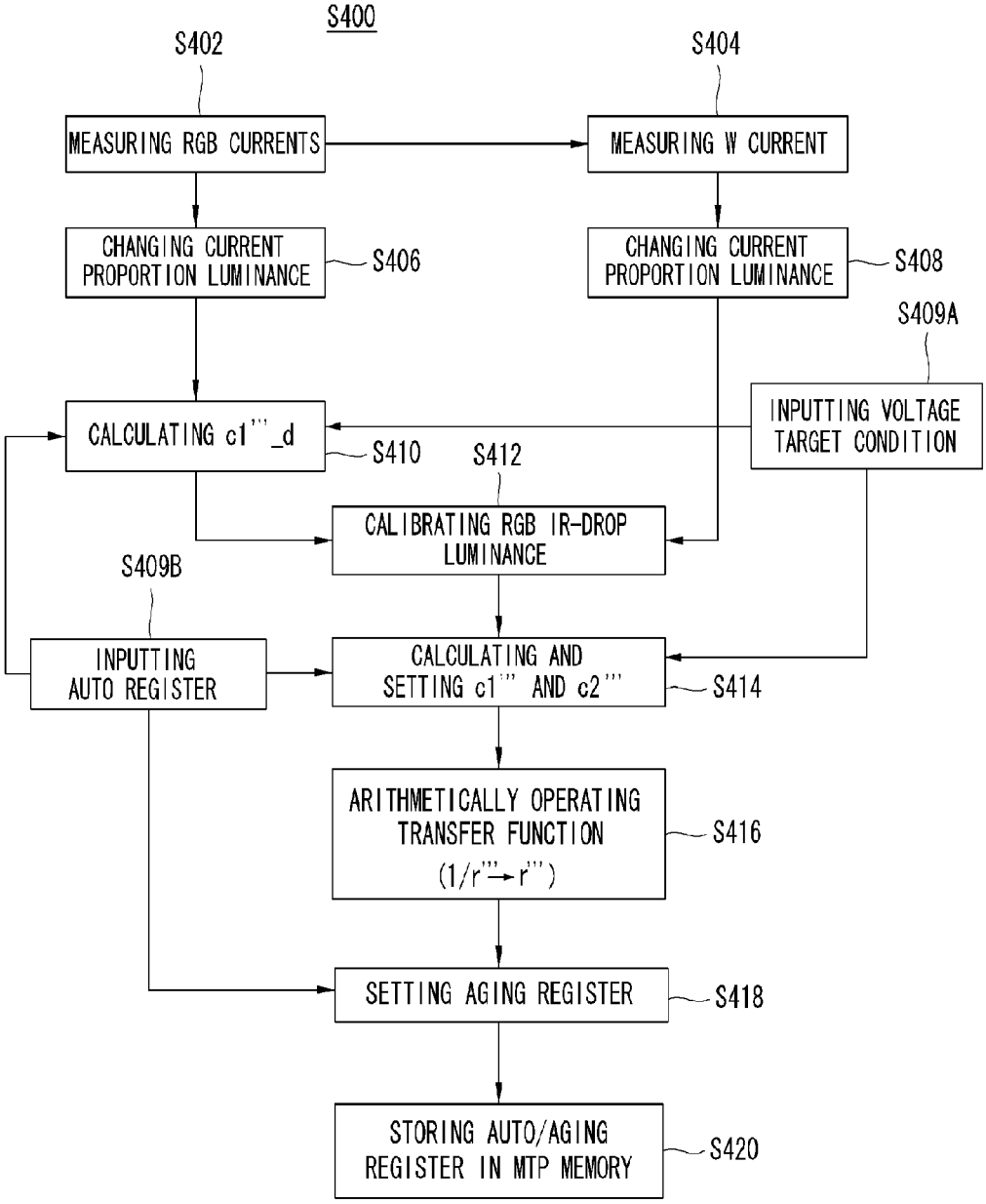
FIG. 29 is a diagram illustrating in detail an aging calibration stage.

FIG. 29 illustrates in detail the aging calibration stage S400.

Referring to FIG. 29, the aging calibration stage S400 downloads the default code that has been set in the auto calibration stage S300, and separately displays the RGB test patterns on the OLED display device, based on the default code, and measures a current for each of the RGB test patterns in stage S402. Each of the RGB test patterns includes eight point grayscale levels (total 24 grayscale levels) of each of RGB data.

The aging calibration stage S400 also measures a current for the eight point grayscale levels of W data when the RGB test patterns are being simultaneously displayed on the OLED display device in stage S404.

In stages S406 and S408, the aging calibration stage S400 converts a measured current value of each of RGBW data into a luminance value, based on the luminance-current ratio value stored in the zero calibration stage S200.

The aging calibration stage S400 applies RGB measurement luminance values to the transfer function to calculate a primary aging calibration transfer factor "c1'"_d" due to static IR drop for each of RGB data, on the basis of the voltage target condition (identical to that of the target calibration stage) and the auto register of the auto calibration stage S300 in stages S409A and S410. Herein, an amount of changed luminance due to static IR drop is reflected in the primary aging calibration transfer factor "c1'"_d" for each grayscale level.

The aging calibration stage S400 applies the W measurement luminance value and the primary aging calibration transfer factor "c1'"_d" to the transfer function to calibrate the luminance change of RGB data due to IR drop in stage S412.

The aging calibration stage S400 calculates secondary aging calibration transfer factors "c1'" and c2'"" from the input voltage target condition, the auto register stored in the auto calibration stage S300, and a luminance value for which static IR drop has been calibrated in stage S414, and calculates a slope factor "r'"" of the voltage transfer function from a slope factor "1/r'"" obtained from the luminance value in stage S416.

The aging calibration stage S400 calculates a voltage transfer function for the target luminance transfer function using the secondary aging calibration transfer factors "c1'", c2'" and r'"", calculates a voltage difference to be compensated using the voltage transfer function, and sets an aging register corresponding to the calculated voltage difference in stages S416 and S418. The aging register is used to update a register value of the cell driving voltage, and set for each of RGB data.

The aging calibration stage S400 stores the aging register in the auto/aging register MTP memory of the data driving IC 42 in stage S420.

The aging calibration stage S400 is an operation that is mainly performed after a product has been manufactured, and performed according to a command signal from a user.

Figure 30:
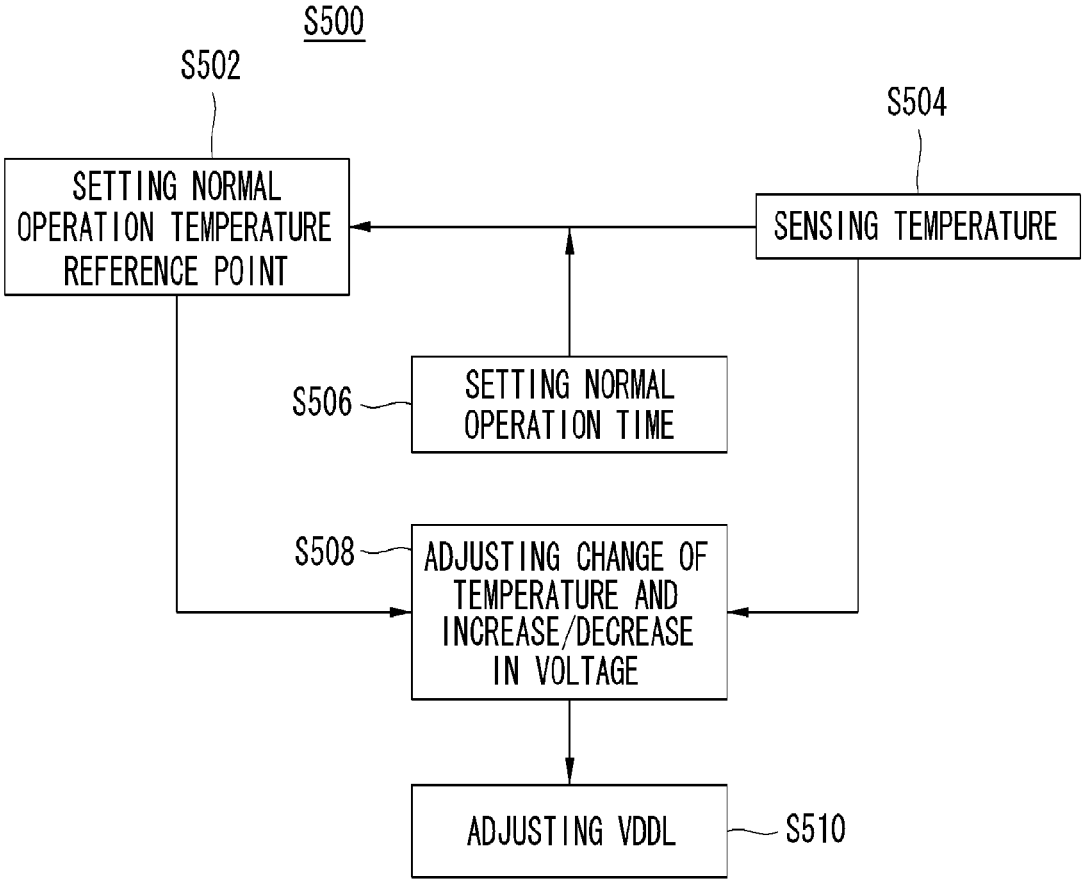
FIGS. 30 and 31 are diagrams illustrating in detail an environment calibration stage.

FIG. 30 illustrates in detail the temperature calibration stage of the environment calibration stage S500.

Referring to FIG. 30, the temperature calibration stage sets a time taken until the OLED display device operates normally in response to the application of a driving voltage, and sets a temperature sensing value immediately after the normal operation time as a normal operation temperature reference point in operations S502 and S504.

The temperature calibration stage compares the normal operation temperature reference point with a temperature sensing value, which is obtained at certain intervals, to sense the change of a temperature at certain intervals within a normal operation period, and adjusts the input level of the low-level gamma source voltage VDDL of the data driving IC 42 according to the change of the temperature in stages S506, S508 and S510.

Figure 31:
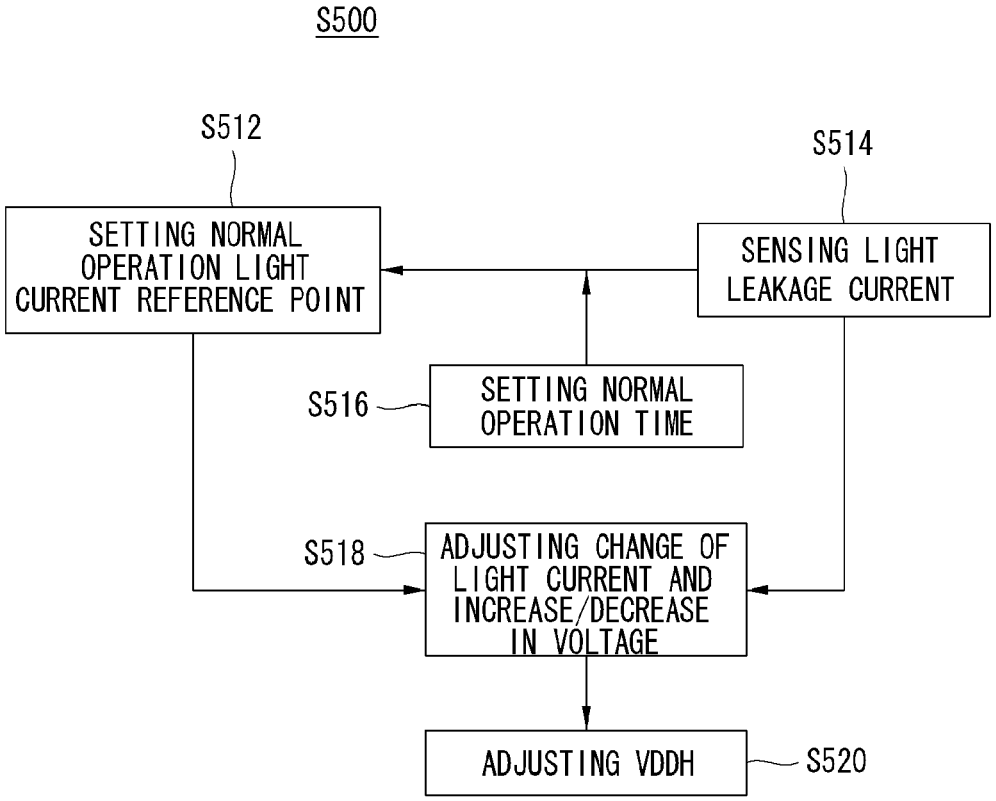

FIG. 31 illustrates in detail the light leakage current calibration stage of the environment calibration stage S500.

Referring to FIG. 31, the light leakage current calibration stage sets a time taken until the OLED display device operates normally in response to the application of a driving voltage, and sets a light leakage current sensing value immediately after the normal operation time as a normal operation light current reference point in operations S512 and S514.

The light leakage current calibration stage compares the normal operation light current reference point with a light current sensing value, which is obtained at certain intervals, to sense the change of a light leakage current at certain intervals within a normal operation period, and adjusts the input level of the high-level gamma source voltage VDDH of the data driving IC 42 according to the change of the light leakage current in stages S516, S518 and S520.

FIG. 32 illustrates an application example of the present invention which maintains white balance by effectively solving IR drop in a large-area screen.

In a large-area screen, at least two or more data driving ICs 42 and gate driving ICs 43 are required. For example, as illustrated in FIG. 31, the data driving ICs 42 include a first data driving IC DDRV1 and a second data driving IC DDRV2, and the gate driving ICs 43 include a first gate driving IC GDRV1 and a second gate driving IC GDRV2.

In this case, a display screen of the OLED panel 44 is divided into a first area AR11 that is driven by the first data driving IC DDRV1 and the first gate driving IC GDRV1, a second area AR21 that is driven by the first data driving IC DDRV1 and the second gate driving IC GDRV2, a third area AR12 that is driven by the second data driving IC DDRV2 and the first gate driving IC GDRV1, and a fourth area AR22 that is driven by the second data driving IC DDRV2 and the second gate driving IC GDRV2.

In the large-area screen, since the deviation of IR drops due to position is large, it is not easy to adjust white balance. Therefore, as in the above-described stages, the present invention calibrates IR drop, and divides the screen into a plurality of driving areas driven by respective data driving ICs and a plurality of driving areas driven by respective gate driving ICs. The present invention separately generates different gamma calibration values due to IR drop for the respective areas, and pre-stores the generated gamma calibration values. Furthermore, the present invention may be designed to respectively apply different gamma calibration values to the divided areas, based on a position where a scan is being performed.

For example, in FIG. 32, on the assumption that a first gamma calibration value is allocated to the first area AR11 and pre-stored, a second gamma calibration value is allocated to the second area AR21 and pre-stored, a third gamma calibration value is allocated to the third area AR12 and pre-stored, and a fourth gamma calibration value is allocated to the fourth area AR22 and pre-stored, when the first gate driving IC GDRV1 performs a scan operation, the first data driving IC DDRV1 may select the first gamma calibration value and the second data driving IC DDRV2 may select the third gamma calibration value, but when the second gate driving IC GDRV2 performs the scan operation, the first data driving IC DDRV1 may select the second gamma calibration value and the second data driving IC DDRV2 may select the fourth gamma calibration value. Accordingly, even in the large-area screen, IR drop can be effectively prevented, and particularly, the change of a gamma voltage can be prevented in a boundary portion between adjacent areas that are divided based on the gate driving ICs.

As described above, the present invention formularizes the voltage transfer function, the luminance transfer function, and the transfer factors (for example, efficiency, critical point, and slope) therebetween, derives the correlation (based on the condition change in all cases) between the input grayscale voltage and the output luminance, and calibrates the input grayscale voltage by a difference between the measurement luminance and the target luminance with the transfer functions.

Therefore, the present invention calibrates a product that fails to meet the target quality due to a cause that occurs in manufacturing, so as to make the product meet the target quality and thus further increases the manufacturing yield by an average of 35% than the existing yield, greatly saving the manufacturing cost.

The present invention can respond the condition change in all cases by calibrating the output luminance, which is caused by the change of the transfer factor, with the grayscale voltage and can increase the accuracy, easiness, and generalization of calibration compared to the existing calibration scheme using the lookup table by checking the actual measurement data and readjusting the transfer factors in each calibration stage.

The present invention acquires the measurement data and performs calibration, based on the transfer function, on a desired part at one time, considerably saving a product manufacturing time (product tack time) in manufacturing.

The present invention calibrates the luminance difference due to the service-life decrease difference between red, green, and blue to the initial luminance of a product using the derived transfer function and the inherent transfer factors of the product, and thus can prevent white balance from being changed or prevent luminance from decreasing due to the service-life decrease difference between red, green, and blue after the product is manufactured.

The present invention may be applied to an operation that senses the ambient environment conditions (for example, ambient temperature, and ambient light) after the manufacture of a product and identically matches the changed driving condition of the product to a normal driving condition at an initial set time, thus maximizing users' convenience.

The present invention changes (static compensation) the gamma register with the transfer function, performs real-time compensation (dynamic compensation) for the input data, and thus reduces crosstalk where luminance becomes non-uniform for each sub-pixel in the same grayscale data and which is caused by the dynamic IR drop due to the change in an amount of data and white unbalance that occurs due to the static IR drop between the separate driving of RGB sub-pixels and the simultaneous driving of the RGB sub-pixels by the resistance difference between the respective positions in the power supply line, considerably enhancing the image quality of a large-area and high-resolution screen.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A calibration system of a display device using transfer functions, the calibration system comprising:

a display panel;

a data driving IC configured to generate a grayscale voltage which is applied to the display panel, according to a predetermined gamma register value;

a transfer function processing unit including:

a voltage transfer function for calculating a voltage condition for a change of luminance;

a luminance transfer function for calculating a luminance value for a change of voltage; and a transfer function algorithm having a plurality of first transfer factors corresponding to a correlation between the voltage transfer function and the luminance transfer function, wherein the transfer function processing unit is configured to apply a measurement luminance value obtained by applying a test pattern having a specific grayscale voltage value to the display panel, a voltage condition, and the predetermined gamma register value to the transfer function algorithm to thereby calculate a plurality of second transfer factors, and calculate an auto register for adjusting the predetermined gamma register value according to a difference between the first and second transfer factors, a driving board including:

a default code memory for storing a default code having a default register which is used to calculate the auto register, a target code memory for storing a target code having a target register which is used to calculate the default register, and a voltage generator for generating a driving voltage necessary for driving the display panel and the data driving IC;

a luminance measurer configured to measure luminance of the display panel upon application of the test pattern and generate luminance measurement data; and a control center configured to receive an initial driving condition of the data driving IC, and apply a work command signal for sequentially performing calibrations and the luminance measurement data to the transfer function processing unit.

2. The calibration system of claim 1, wherein the transfer function processing unit is mounted on one of the data driving IC and the driving board.

3. The calibration system of claim 1, wherein, the luminance transfer function is divided into a high luminance transfer function corresponding to a high luminance section and a low luminance transfer function corresponding to a low luminance section, a first critical luminance in the high luminance section is selected amongst measurement luminance values so that low luminance values can be stably obtained, and a second critical luminance in the low luminance section is a luminance which is decided in setting a target luminance, or a luminance estimated using the high luminance transfer function.

4. The calibration system of claim 1, wherein, the transfer function processing unit separately calculates the second transfer factors under a voltage condition and a luminance condition of a corresponding calibration stage whenever a plurality of calibration stages are performed, and calculates a difference between the first transfer factors and the second transfer factors, the first transfer factors being set in a calibration stage immediately before the corresponding calibration stage, and each of the first and second transfer factors comprises: an efficiency proportion factor which is defined as a value transferring energy change between an input voltage and an output luminance; a critical point proportion factor which is defined as a threshold voltage condition where an OLED of the display panel is actually driven when the input voltage is applied; and a slope factor which is a slope value comprised in the voltage transfer function and the luminance transfer function, and defined as a voltage change amount and a luminance change amount in each of a plurality of grayscale levels.

5. The calibration system of claim 1, wherein, in a target calibration stage, the transfer function processing unit applies a target luminance value and an arbitrary grayscale voltage value to the transfer function algorithm to calculate a plurality of target calibration transfer factors, matches a slope factor of the voltage transfer function with a slope factor of the luminance transfer function to calculate the target register through a transfer function operation using the target calibration transfer factors, and updates a predetermined initial code of an initial register with the target register, in a zero calibration stage succeeding the target calibration stage, the transfer function processing unit calculates a plurality of zero calibration transfer factors based on a measurement luminance value which is obtained by applying a grayscale voltage value based on the target register to the display panel, applies the zero calibration transfer factors and the target luminance value to the transfer function algorithm to calculate the default register for changing the gamma register value by a difference between the target calibration transfer factors and the zero calibration transfer factors, and updates the target register with the default register, and in an auto calibration stage succeeding the zero calibration stage, the transfer function processing unit calculates a plurality of auto calibration transfer factors based on a measurement luminance value which is obtained by applying a specific grayscale voltage value based on the default register to the display panel, applies the auto calibration transfer factors and the target luminance value to the transfer function algorithm to calculate the auto register for changing the gamma register value by a difference between the zero calibration transfer factors and the auto calibration transfer factors, and stores the calculated auto register in an auto/aging register multi time programmable (MPT) memory of the data driving IC.

6. The calibration system of claim 5, wherein the data driving IC further comprises:

a reference source current value MTP memory configured to store a luminance-current ratio value which is obtained in the zero calibration stage, the luminance-current ratio value being determined based on a current value which flows in a supply line for driving a high-level cell of the display panel in target luminance between grayscale levels; and a source current detection unit configured to sense a source current value due to a decrease in service life.

7. The calibration system of claim 6, wherein in an aging calibration stage succeeding the auto calibration stage, the transfer function processing unit calculates a luminance value corresponding to the source current value due to the decrease in the service life, calculates a plurality of aging calibration transfer factors based on the luminance value, applies the aging calibration transfer factors and the target luminance value to the transfer function algorithm to calculate an aging register for adjusting a cell driving voltage of the display panel by a difference between the auto calibration transfer factors and the aging calibration transfer factors, and stores the calculated aging register in the auto/aging register MTP memory of the data driving IC.

8. The calibration system of claim 5, wherein the data driving IC further comprises:

a temperature detection unit configured to store a temperature sensing value immediately after the display panel operates normally in response to application of a driving voltage, as a normal operation temperature reference value, and compare the normal operation temperature reference value with a temperature sensing value to sense change of a temperature at certain intervals within a normal operation period; and a light leakage current detection unit configured to store a light leakage current sensing value immediately after the display panel operates normally, as a normal operation light current reference value, and compare the normal operation light current reference value with a light current sensing value to sense change of a light leakage current at certain intervals within the normal operation period; and the transfer function processing unit adjusts an input level of a low-level gamma source voltage for generating the grayscale voltage according to the change of the temperature, and adjusts an input level of a high-level gamma source voltage for generating the grayscale voltage according to the change of the light leakage current.

9. The calibration system of claim 1, wherein the data driving IC further comprises a grayscale voltage generation circuit configured to generate the grayscale voltage, the grayscale voltage generation circuit comprising:

a DY1 adjustment unit including a first dynamic resistor connected to an input terminal of a high-level gamma source voltage and a first dynamic register, and configured to adjust an input level of the high-level gamma source voltage in response to a change of a resistance value of the first dynamic resistor based on the first dynamic register;

a DY2 adjustment unit including a second dynamic resistor connected to an input terminal of a low-level gamma source voltage and a second dynamic register, and configured to adjust an input level of the low-level gamma source voltage in response to a change of a resistance value of the second dynamic resistor based on the second dynamic register;

an offset adjustment unit connected to the DY1 adjustment unit, and configured to adjust an offset of the voltage transfer function and an offset of the luminance transfer function;

a gain adjustment unit connected to the DY2 adjustment unit, and configured to adjust a gain of the voltage transfer function and a gain of the luminance transfer function; and a gamma voltage adjustment unit including a plurality of slope variable resistors and gamma registers connected to and disposed between the offset adjustment and the gain adjustment unit, and configured to adjust a slope of the voltage transfer function and a slope of the luminance transfer function in response to a change of resistance values of the slope variable resistors based on the gamma registers.

10. The calibration system of claim 6, wherein, the transfer function processing unit performs white balance calibration in consideration of an IR drop in the target calibration stage, the zero calibration stage, the auto calibration stage, and the aging calibration stage, and the IR drop comprises a static IR drop due to a line resistor, and a dynamic IR drop due to an amount of changed display data.

11. The calibration system of claim 10, wherein, the static IR drop is measured in a white data state indicating a maximum drop amount, and used in adjusting a gamma register value by the transfer function processing unit, and the dynamic IR drop is calculated by analyzing a change of input data, and used to compensate the input data in real time.

12. The calibration system of claim 11, wherein the data driving IC further comprises an IR drop compensation unit configured to calibrate the dynamic IR drop, the IR drop compensation unit comprising:

a grayscale detector configured to analyze input digital image data, detect a grayscale level causing crosstalk based on the number of grayscale levels and a luminance difference between grayscale levels in each of a plurality of horizontal lines or vertical lines, and calculate a dynamic IR drop amount based on an amount of data having a grayscale level causing the crosstalk; and a data compensator configured to generate compensation data in a form of voltage difference, and add the compensation data to the input digital image data, the voltage difference corresponding to a luminance difference due to the dynamic IR drop.

13. The calibration system of claim 10, further comprising a plurality of gate driving ICs, wherein, the display panel is divided into a plurality of driving areas and driven according to the data driving IC and the gate driving ICs, and white balance calibration based on the IR drop is separately performed for each of the driving areas.

14. A calibration method of a display device using transfer functions, the calibration method comprising:

executing an algorithm which is a transfer function comprising a voltage transfer function and a luminance transfer function, for calibrating change of an output luminance to a desired value through calibration of an input voltage;

performing a target calibration stage of applying a target luminance value and an arbitrary grayscale voltage value to the transfer function to calculate a plurality of target calibration transfer factors, and matching a slope factor of the voltage transfer function with a slope factor of the luminance transfer function to calculate a target register through a transfer function operation using the target calibration transfer factors;

performing a zero calibration stage of applying a measurement luminance value, which is obtained by applying a grayscale voltage value based on the target register to the display panel, to the transfer function to calculate a plurality of zero calibration transfer factors, and applying the zero calibration transfer factors and the target luminance value to the transfer function to calculate a default register for compensating for a difference between the target calibration transfer factors and the zero calibration transfer factors with a gamma voltage; and performing an auto calibration stage of applying a measurement luminance value, which is obtained by applying a grayscale voltage value based on the default register to the display panel, to the transfer function to calculate a plurality of auto calibration transfer factors, and applying the auto calibration transfer factors and the target luminance value to the transfer function to calculate a default register for compensating for a difference between the zero calibration transfer factors and the auto calibration transfer factors with a gamma voltage.

15. The calibration method of claim 14, wherein, the voltage transfer function and the luminance transfer function are correlated to each other through a slope factor matching operation in the target calibration stage, a plurality of transfer factors are separately calculated under a voltage condition and luminance condition of a corresponding calibration stage whenever each of the calibration stages is performed, and each of the transfer factors comprises: an efficiency proportion factor which is defined as a value transferring energy change between an input voltage and an output luminance; a critical point proportion factor which is defined as a threshold voltage condition where an OLED of the display panel is actually driven when the input voltage is applied; and a slope factor which is a slope value comprised in the voltage transfer function and the luminance transfer function, and defined as a voltage change and a luminance change in each of a plurality of grayscale levels.

16. The calibration method of claim 14, further comprising:

performing an aging calibration stage of calculating a relative amount of current decreased due to a reduction in service life on the basis of a current reference value which flows in a supply line for driving a cell of the display panel and has been secured in the zero calibration stage, and calculating an aging register for adjusting a cell driving voltage on the basis of the calculated relative amount of current; and performing an environment calibration stage comprising temperature calibration and light leakage current calibration to compensate for a normal driving condition which is changed by an ambient temperature and a light leakage current.

17. The calibration method of claim 14, wherein, the luminance transfer function is divided into a high luminance transfer function corresponding to a high luminance section and a low luminance transfer function corresponding to a low luminance section, a first critical luminance in the high luminance section is selected amongst measurement luminance values so that low luminance values can be stably obtained, and a second critical luminance in the low luminance section is a luminance which is decided in setting a target luminance, or a luminance estimated using the high luminance transfer function.

18. The calibration method of claim 16, wherein, white balance calibration is performed based on an IR drop in the target calibration stage, the zero calibration stage, the auto calibration stage, and the aging calibration stage, the IR drop comprises a static IR drop due to a line resistor, and a dynamic IR drop due to an amount of changed display data, the static IR drop is measured in a white data state indicating a maximum drop amount, and used in adjusting a gamma register value, and the dynamic IR drop is calculated by analyzing a change of input data, and used to compensate the input data in real time.

19. The calibration method of claim 16, wherein the auto calibration stage comprises:

downloading a default code comprising the default register, displaying a grayscale level corresponding to a maximum luminance of each of RGBW data, a grayscale level corresponding to a slope luminance of at least one of the RGBW data, and a grayscale level corresponding to a critical point luminance of at least one of the RGBW data on the display panel, and measuring a luminance;

applying a measurement luminance value of each of the RGB data to the transfer function to calculate a plurality of primary auto calibration transfer factors due to an IR drop, based on the default register;

applying a measurement luminance value of the W data and the primary auto calibration transfer factors to the transfer function to calibrate an RGB luminance which is changed due to the IR drop;

applying the default register and a luminance value, for which the IR drop has been calibrated, to the transfer function to calculate a plurality of secondary auto calibration transfer factors;

calculating a voltage difference through a transfer function operation using the secondary auto calibration transfer factors and the luminance value for which the IR drop has been calibrated; and updating the default register with the auto register.

20. The calibration method of claim 16, wherein, the target calibration stage, the zero calibration stage, and the auto calibration stage are performed before completion of a product, and the aging calibration stage and the environment calibration stage are performed after a complete product has been produced.

* * * * *